US011045066B2

(12) United States Patent
Fawaz et al.

(10) Patent No.: US 11,045,066 B2
(45) Date of Patent: Jun. 29, 2021

(54) DISHWASHER WITH KEYED COUPLING TO RACK-MOUNTED CONDUIT

(71) Applicant: Midea Group Co., Ltd., Foshan (CN)

(72) Inventors: Bassam Fawaz, Louisville, KY (US); Joel Boyer, Louisville, KY (US); Robert M. Digman, Goshen, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 149 days.

(21) Appl. No.: 16/298,007

(22) Filed: Mar. 11, 2019

(65) Prior Publication Data

US 2020/0288940 A1 Sep. 17, 2020

(51) Int. Cl.

| | |
|---|---|
| ***A47L 15/30*** | (2006.01) |
| ***A47L 15/42*** | (2006.01) |
| ***A47L 15/00*** | (2006.01) |
| ***A47L 15/50*** | (2006.01) |
| ***A47L 15/22*** | (2006.01) |

(52) U.S. Cl.

CPC ..... *A47L 15/30* (2013.01); *A47L 15/0021* (2013.01); *A47L 15/22* (2013.01); *A47L 15/428* (2013.01); *A47L 15/4217* (2013.01); *A47L 15/50* (2013.01); *A47L 15/4263* (2013.01)

(58) Field of Classification Search

CPC ..... A47L 15/00–508

See application file for complete search history.

(56) References Cited

U.S. PATENT DOCUMENTS

| | | | |
|---|---|---|---|
| 2,734,520 | A | 2/1956 | Abresch |
| 2,808,063 | A | 10/1957 | Abresch et al. |
| 2,907,335 | A | 10/1959 | Abresch |
| 2,992,779 | A | 1/1960 | James et al. |
| 2,939,465 | A | 6/1960 | Kesling |
| 2,956,572 | A | 10/1960 | Levit et al. |
| 2,973,907 | A | 3/1961 | Abresch et al. |
| 2,980,120 | A | 4/1961 | Jacobs |
| 3,006,557 | A | 10/1961 | Jacobs |
| 3,026,046 | A | 3/1962 | Wickham et al. |
| 3,044,842 | A | 7/1962 | Abresch et al. |

(Continued)

FOREIGN PATENT DOCUMENTS

| | | |
|---|---|---|
| CN | 2094961 U | 2/1992 |
| CN | 2395683 Y | 9/2000 |

(Continued)

OTHER PUBLICATIONS

Encyclo, "Keyed Connector—Definition—Encyclo", https://www.encyclo.co.uk/meaning-of-Keyed_connectors (Year: 2020).*

(Continued)

*Primary Examiner* — Michael E Barr
*Assistant Examiner* — Omair Chaudhri
(74) *Attorney, Agent, or Firm* — Middleton Reutlinger

(57) ABSTRACT

A dishwasher and method for operating the same utilize a rack-mounted rotatable conduit incorporating a keyed connector disposed at an end thereof and configured to mate with a rotatable docking port disposed on a wall of a wash tub at a predetermined angular relationship when the rack is in the washing position such that rotation of the rotatable docking port causes rotation of the rotatable conduit.

19 Claims, 7 Drawing Sheets

(56) References Cited

U.S. PATENT DOCUMENTS

| | | | |
|---|---|---|---|
| 3,051,183 | A | 8/1962 | Jacobs |
| 3,077,200 | A | 2/1963 | Guth |
| 3,082,779 | A | 3/1963 | Jacobs |
| 3,088,474 | A | 5/1963 | Leslie |
| 3,101,730 | A | 8/1963 | Harris et al. |
| 3,115,306 | A | 12/1963 | Graham |
| 3,178,117 | A | 4/1965 | Hanifan |
| 3,192,935 | A | 7/1965 | Hanifan |
| 3,210,010 | A | 10/1965 | Delapena |
| 3,324,867 | A | 6/1967 | Freese |
| 3,348,775 | A | 10/1967 | Flame |
| 3,361,361 | A | 1/1968 | Schutte |
| 3,454,784 | A | 7/1969 | Wantz et al. |
| 3,538,927 | A | 11/1970 | Harald |
| 3,586,011 | A | 6/1971 | Mazza |
| 3,590,688 | A | 7/1971 | Brannon |
| 3,596,834 | A | 8/1971 | Cushing |
| 3,719,323 | A | 3/1973 | Raiser |
| 4,175,575 | A | 11/1979 | Cushing |
| 4,226,490 | A | 10/1980 | Jenkins et al. |
| 4,301,822 | A | 11/1981 | Dingier |
| 4,398,562 | A | 8/1983 | Saarem et al. |
| 4,657,188 | A | 4/1987 | Crane et al. |
| 4,718,440 | A | 1/1988 | Hawker et al. |
| 4,732,323 | A | 3/1988 | Jarvis et al. |
| 4,822,241 | A | 4/1989 | Jarvis et al. |
| 5,211,190 | A | 5/1993 | Johnson et al. |
| 5,226,454 | A | 7/1993 | Cabalfin |
| 5,341,827 | A | 8/1994 | Kim |
| 5,697,392 | A | 12/1997 | Johnson et al. |
| 5,725,002 | A | 3/1998 | Payzant |
| 5,752,533 | A | 5/1998 | Edwards |
| 5,927,616 | A | 7/1999 | Grise et al. |
| 6,053,185 | A | 3/2000 | Cirjak et al. |
| 6,431,188 | B1 | 8/2002 | Laszczewski, Jr. et al. |
| 6,612,009 | B1 | 9/2003 | Laszczewski, Jr. et al. |
| 6,694,990 | B2 | 2/2004 | Spanyer et al. |
| 6,869,029 | B2 | 3/2005 | Ochoa et al. |
| 7,055,537 | B2 | 6/2006 | Elick et al. |
| 7,210,315 | B2 | 5/2007 | Castelli et al. |
| 7,293,435 | B2 | 11/2007 | Elexpuru et al. |
| 7,445,013 | B2 | 11/2008 | VanderRoest et al. |
| 7,464,718 | B2 | 12/2008 | McIntyre et al. |
| 7,556,049 | B2 | 7/2009 | Oakes et al. |
| 7,587,916 | B2 | 9/2009 | Rizzetto |
| 7,594,513 | B2 | 9/2009 | VanderRoest et al. |
| 7,607,325 | B2 | 10/2009 | Elexpuru et al. |
| 7,650,765 | B2 | 1/2010 | Rizzetto |
| 7,914,625 | B2 | 3/2011 | Bertsch et al. |
| 7,935,194 | B2 | 5/2011 | Rolek |
| 8,136,537 | B2 | 3/2012 | Cerrano et al. |
| 8,161,995 | B2 | 4/2012 | Armstrong et al. |
| 8,191,560 | B2 | 6/2012 | Mallory et al. |
| 8,443,765 | B2 | 5/2013 | Hollis |
| 8,696,827 | B2 | 4/2014 | Ashrafzadeh et al. |
| 8,778,094 | B2 | 7/2014 | Blanchard et al. |
| 8,858,729 | B2 | 10/2014 | Buddharaju et al. |
| 8,900,375 | B2 | 12/2014 | Gnadinger et al. |
| 8,915,257 | B2 | 12/2014 | Büsing et al. |
| 8,932,411 | B2 | 1/2015 | Beaudet et al. |
| 8,978,674 | B2 | 3/2015 | Buesing |
| 8,985,128 | B2 | 3/2015 | Pyo et al. |
| 9,121,217 | B1 | 9/2015 | Hoffberg |
| 9,170,584 | B2 | 10/2015 | Lum et al. |
| 9,204,780 | B2 | 12/2015 | Francisco et al. |
| 9,220,393 | B2 | 12/2015 | Becker et al. |
| 9,241,604 | B2 | 1/2016 | Dries |
| 9,259,137 | B2 | 2/2016 | Boyer et al. |
| 9,265,400 | B2 | 2/2016 | Bigott |
| 9,307,888 | B2 | 4/2016 | Baldwin et al. |
| 9,326,657 | B2 | 5/2016 | Thiyagarajan |
| 9,480,389 | B2 | 11/2016 | Haft et al. |
| 9,492,055 | B2 | 11/2016 | Feddema |
| 9,532,700 | B2 | 1/2017 | Welch |
| 9,635,994 | B2 | 5/2017 | Boyer et al. |
| 9,655,496 | B2 | 5/2017 | Baldwin et al. |
| 9,915,356 | B2 | 3/2018 | Chang et al. |
| 9,958,073 | B2 | 5/2018 | Yang |
| 10,524,634 | B2 | 1/2020 | Digman |
| 10,531,781 | B2 | 1/2020 | Digman et al. |
| 10,631,708 | B2 | 4/2020 | Digman et al. |
| 10,765,291 | B2 | 9/2020 | Digman et al. |
| 2005/0011544 | A1 | 1/2005 | Rosenbauer et al. |
| 2005/0139240 | A1 | 6/2005 | Bong et al. |
| 2005/0241680 | A1 | 11/2005 | Noh |
| 2005/0241681 | A1 | 11/2005 | Hwang |
| 2006/0090778 | A1* | 5/2006 | Oakes ..... A47L 15/4257 134/56 D |
| 2006/0278258 | A1 | 12/2006 | Kara et al. |
| 2007/0215187 | A1 | 9/2007 | Koch et al. |
| 2008/0163904 | A1 | 7/2008 | Hwang |
| 2008/0271765 | A1 | 11/2008 | Burrows |
| 2008/0276975 | A1 | 11/2008 | Disch |
| 2009/0071508 | A1 | 3/2009 | Sundaram et al. |
| 2009/0090400 | A1 | 4/2009 | Burrows et al. |
| 2009/0145468 | A1 | 6/2009 | Chericoni |
| 2010/0043826 | A1 | 2/2010 | Bertsch et al. |
| 2011/0186085 | A1 | 8/2011 | Chen et al. |
| 2012/0060875 | A1 | 3/2012 | Fauth et al. |
| 2012/0175431 | A1 | 7/2012 | Althammer et al. |
| 2012/0291827 | A1 | 11/2012 | Buddharaju et al. |
| 2013/0000762 | A1 | 1/2013 | Buddharaju et al. |
| 2013/0068265 | A1* | 3/2013 | Gnadinger ..... A47L 15/508 134/184 |
| 2013/0137621 | A1* | 5/2013 | Kessler ..... A47L 15/4445 510/220 |
| 2013/0319483 | A1 | 12/2013 | Welch |
| 2014/0059880 | A1 | 3/2014 | Bertsch et al. |
| 2014/0069470 | A1 | 3/2014 | Baldwin et al. |
| 2014/0373876 | A1 | 12/2014 | Feddema |
| 2015/0007861 | A1 | 1/2015 | Azmi et al. |
| 2015/0266065 | A1 | 9/2015 | Savoia |
| 2016/0198928 | A1 | 7/2016 | Xu et al. |
| 2017/0135548 | A1 | 5/2017 | Swarnkar |
| 2017/0181599 | A1 | 6/2017 | Choi et al. |
| 2017/0224190 | A1 | 8/2017 | Sakthivel et al. |
| 2017/0265707 | A1 | 9/2017 | Roderick et al. |
| 2017/0273535 | A1 | 9/2017 | Roderick et al. |
| 2017/0354308 | A1 | 12/2017 | Choi et al. |
| 2018/0035863 | A1 | 2/2018 | Liu et al. |
| 2018/0084967 | A1 | 3/2018 | Ross et al. |
| 2018/0110397 | A1 | 4/2018 | Kim et al. |
| 2018/0132692 | A1 | 5/2018 | Dries |
| 2018/0168425 | A1 | 6/2018 | Wilson et al. |
| 2018/0192851 | A1 | 7/2018 | Gursoy et al. |
| 2018/0220870 | A1 | 8/2018 | Beshears, Jr. et al. |
| 2018/0333037 | A1 | 11/2018 | Roderick et al. |
| 2018/0360293 | A1 | 12/2018 | Boyer |
| 2019/0059688 | A1 | 2/2019 | Woo et al. |
| 2019/0099054 | A1 | 4/2019 | Digman et al. |
| 2019/0099056 | A1* | 4/2019 | Digman ..... A47L 15/23 |
| 2019/0191959 | A1* | 6/2019 | Brightbill ..... A47L 15/4278 |
| 2019/0290095 | A1* | 9/2019 | Wahlberg ..... A47L 15/0063 |
| 2019/0307308 | A1 | 10/2019 | Haegermarck |
| 2020/0077868 | A1* | 3/2020 | Digman ..... A47L 15/486 |
| 2020/0085277 | A1 | 3/2020 | Digman et al. |
| 2020/0085279 | A1 | 3/2020 | Digman et al. |
| 2020/0107696 | A1 | 4/2020 | Digman et al. |

FOREIGN PATENT DOCUMENTS

| | | | |
|---|---|---|---|
| CN | 1879547 | A | 12/2006 |
| CN | 101049224 | A | 10/2007 |
| CN | 101134198 | A | 3/2008 |
| CN | 201067392 | Y | 6/2008 |
| CN | 101795613 | A | 8/2010 |
| CN | 102307508 | A | 1/2012 |
| CN | 102370450 | A | 3/2012 |
| CN | 102512128 | A | 6/2012 |
| CN | 102940476 | A | 2/2013 |
| CN | 203447254 | U | 2/2014 |
| CN | 203749364 | U | 8/2014 |
| CN | 203763025 | U | 8/2014 |
| CN | 104433985 | A | 3/2015 |

(56) References Cited

FOREIGN PATENT DOCUMENTS

| | | | |
|---|---|---|---|
| CN | 104523208 | A | 4/2015 |
| CN | 104757921 | A | 7/2015 |
| CN | 104840165 | A | 8/2015 |
| CN | 204671085 | U | 9/2015 |
| CN | 105147218 | A | 12/2015 |
| CN | 105231971 | A | 1/2016 |
| CN | 205094364 | U | 3/2016 |
| CN | 105286746 | B | 2/2018 |
| DE | 3537184 | A1 | 4/1987 |
| DE | 20113227 | U1 | 10/2001 |
| DE | 10121083 | A1 | 10/2002 |
| DE | 10300501 | A1 | 7/2004 |
| DE | 202004013786 | U1 | 12/2004 |
| DE | 102008011743 | A1 | 9/2009 |
| DE | 202014010365 | U1 | 5/2015 |
| EP | 0559466 | A1 | 9/1993 |
| EP | 0679365 | A1 | 11/1995 |
| EP | 0764421 | A1 | 3/1997 |
| EP | 0786231 | A2 | 7/1997 |
| EP | 0864291 | A1 | 9/1998 |
| EP | 1132038 | A2 | 9/2001 |
| EP | 1136030 | A1 | 9/2001 |
| EP | 1238622 | A2 | 9/2002 |
| EP | 1252856 | A2 | 10/2002 |
| EP | 1632166 | A2 | 3/2006 |
| EP | 1758494 | A1 | 3/2007 |
| EP | 2636786 | A1 | 9/2013 |
| EP | 2059160 | B1 | 3/2015 |
| FR | 1473796 | A | 3/1967 |
| GB | 572623 | A | 10/1945 |
| GB | 2244209 | A | 11/1991 |
| JP | 2003339607 | A | 12/2003 |
| JP | 2014121353 | A | 7/2014 |
| KR | 100786069 | B1 | 12/2007 |
| KR | 200442414 | Y1 | 11/2008 |
| KR | 101173691 | B1 | 8/2012 |
| KR | 200464747 | Y1 | 1/2013 |
| WO | 2009008827 | A1 | 1/2009 |
| WO | 2016008699 | A1 | 1/2016 |
| WO | 2017022974 | A1 | 2/2017 |
| WO | 2018053635 | A1 | 3/2018 |
| WO | 2018107833 | A1 | 6/2018 |
| WO | 2018107834 | A1 | 6/2018 |
| WO | 2018107835 | A1 | 6/2018 |

OTHER PUBLICATIONS

International Search Report and Written Opinion issued in Application No. PCT/CN2019/079236 dated Jun. 25, 2019.
International Search Report and Written Opinion issued in Application No. PCT/CN2019/078799 dated Jun. 26, 2019.
International Search Report and Written Opinion issued in Application No. PCT/CN2019/078612 dated Jun. 28, 2019.
Transmittal of Related Applications.
International Search Report and Written Opinion issued in Application No. PCT/CN2018/074294 dated Jul. 5, 2018.
International Search Report and Written Opinion issued in Application No. PCT/CN2018/074268 dated Jul. 13, 2018.
SCRIBD, Sears Kenmore Elite 2013 Stainless Steel Tall Tub Dishwasher Service Manual, www.scribd.com, Retrieved on Dec. 5, 2018.
EVERYSPEC, Federal Specification: Dishwashing Machines, Single Tank and Double Tank, Commercial, www.everyspec.com, Oct. 17, 1983.
International Search Report and Written Opinion issued in Application No. PCT/CN2019/078611 dated Jun. 5, 2019.
U.S. Patent Office; Non-Final Office Action issued in U.S. Appl. No. 15/721,099 dated Jul. 30, 2019.
DE10121083A1 machine translation (Year: 2002).
International Search Report and Written Opinion issued in Application No. PCT/CN2019/097332 dated Dec. 9, 2019.
Electrolux Home Products, Inc. "Dishwasher Use & Care Guide 1500 Series with Fully Electronic Control" 2003.
U.S. Patent and Trademark Office, Final Office Action issued in U.S. Appl. No. 16/132,106 dated Jan. 7, 2021.
International Search Report and Written Opinion issued in Application No. PCT/CN2020/108004 dated Oct. 26, 2020.
U.S. Patent and Trademark Office, Advisory Action issued in U.S. Appl. No. 16/132,106 dated Mar. 26, 2021.

* cited by examiner

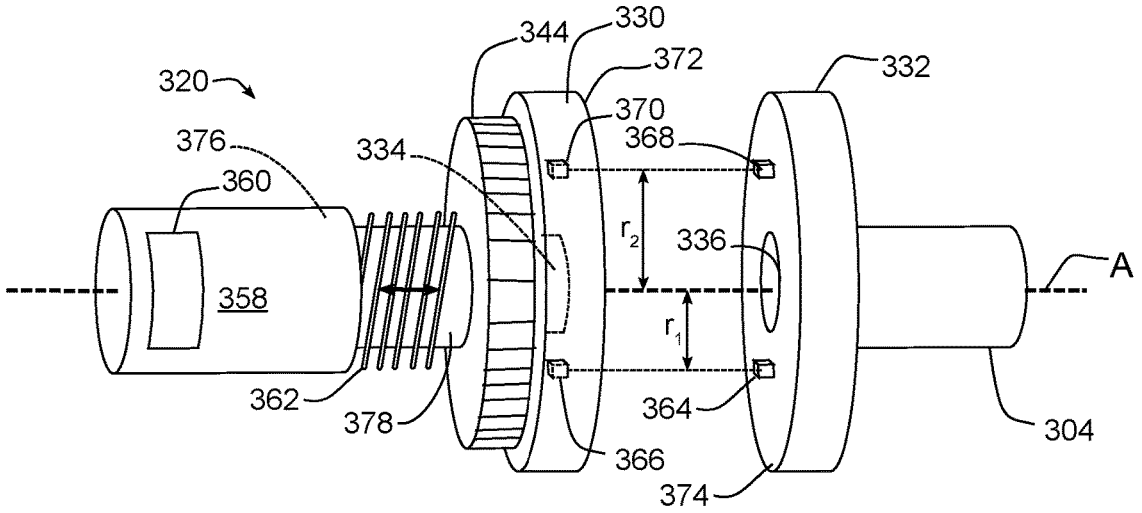
FIG. 15
FIG. 16
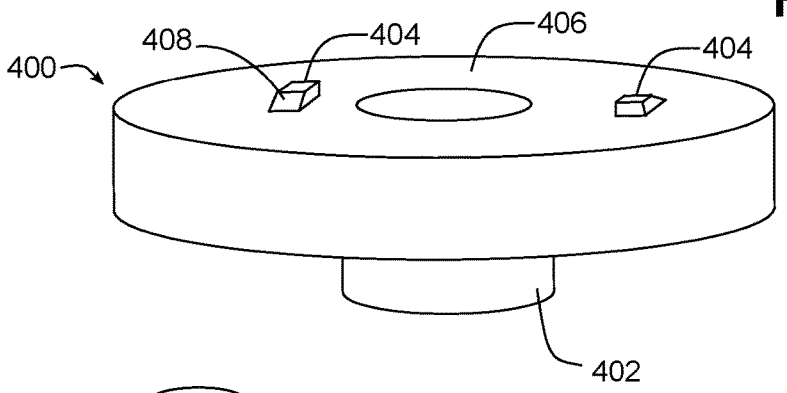
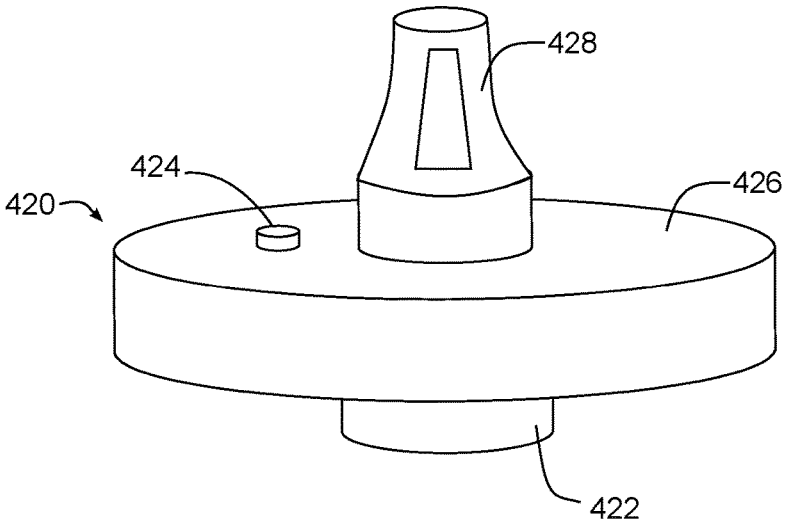
FIG. 17

DISHWASHER WITH KEYED COUPLING TO RACK-MOUNTED CONDUIT

BACKGROUND

Dishwashers are used in many single-family and multi-family residential applications to clean dishes, silverware, cutlery, cups, glasses, pots, pans, etc. (collectively referred to herein as "utensils"). Many dishwashers rely primarily on rotatable spray arms that are disposed at the bottom and/or top of a tub and/or are mounted to a rack that holds utensils. A spray arm is coupled to a source of wash fluid and includes multiple apertures for spraying wash fluid onto utensils, and generally rotates about a central hub such that each aperture follows a circular path throughout the rotation of the spray arm. The apertures may also be angled such that force of the wash fluid exiting the spray arm causes the spray arm to rotate about the central hub.

While traditional spray arm systems are simple and mostly effective, they have the short coming of that they must spread the wash fluid over all areas equally to achieve a satisfactory result. In doing so resources such as time, energy and water are generally wasted because wash fluid cannot be focused precisely where it is needed. Moreover, because spray arms follow a generally circular path, the corners of a tub may not be covered as thoroughly, leading to lower cleaning performance for utensils located in the corners of a rack. In addition, in some instances the spray jets of a spray arm may be directed to the sides of a wash tub during at least portions of the rotation, leading to unneeded noise during a wash cycle.

SUMMARY

The herein-described embodiments address these and other problems associated with the art by providing a dishwasher and method for operating the same utilizing a rack-mounted rotatable conduit with a keyed coupling to a rotatable docking port disposed on a wall of a dishwasher tub. The rack-mounted rotatable conduit, for example, may rotate about its longitudinal axis and may include one or more apertures or nozzles capable of spraying a fluid such as wash fluid and/or pressurized air in a predetermined direction, and the keyed coupling to the rotatable docking port may enable a predetermined angular relationship between the rotatable conduit and the rotatable docking port to be reestablished after the rotatable conduit has been disconnected from the rotatable docking port, e.g., subsequent to a rack upon which the rotatable conduit has been mounted has been moved between loading and washing positions.

Therefore, consistent with one aspect of the invention, a dishwasher may include a wash tub, a rotatable docking port coupled to a wall of the wash tub and in fluid communication with a fluid supply, a rack supported in the wash tub and movable between loading and washing positions, a rotatable conduit supported by the rack for movement with the rack and configured to receive fluid from the rotatable docking port when the rack is in the washing position, and a keyed connector disposed at an end of the rotatable conduit facing the rotatable docking port. The keyed connector may be configured to mate with the rotatable docking port at a predetermined angular relationship to the rotatable docking port when the rack is in the washing position such that rotation of the rotatable docking port causes rotation of the rotatable conduit.

In some embodiments, the rack is adjustable between first and second elevations within the wash tub, the rotatable docking port is a first rotatable docking port positioned to receive the connector of the rotatable conduit when the rack is adjusted to the first elevation and disposed in the washing position, and the docking arrangement includes a second rotatable docking port positioned to receive the connector of the rotatable conduit when the rack is adjusted to the second elevation and disposed in the washing position. Also, in some embodiments, the conduit includes a tubular spray element being rotatable about a longitudinal axis thereof, the tubular spray element includes one or more apertures extending through an exterior surface thereof to spray fluid received from the rotatable docking port, and the dishwasher further includes a tubular spray element drive coupled to the rotatable docking port to rotate the rotatable docking port to discretely direct the tubular spray element to each of a plurality of rotational positions about the longitudinal axis thereof. Further, in some embodiments, the keyed connector is configured to permit relative rotation between the rotatable conduit and the rotatable docking port when the rack is in the washing position and the keyed connector and the rotatable docking port are not at the predetermined angular relationship, and rotation of the rotatable docking port to the predetermined angular relationship causes the keyed connector to mate with the rotatable docking port such that further rotation of the rotatable docking port causes rotation of the rotatable conduit.

Some embodiments may further include a controller coupled to the tubular spray element drive, where the controller is configured to track a rotational position of the rotatable docking port, and where the controller is configured to, prior to discretely directing the tubular spray element to a predetermined rotational position, rotate the rotatable docking port a predetermined amount of rotation to ensure that the rotatable docking port rotates to the predetermined angular relationship to cause the keyed connector to mate with the rotatable docking port. In some embodiments, the tubular spray element drive includes a stepper motor including a position sensor, where the stepper motor includes a first gear coupled to a drive shaft thereof, where the rotatable docking port includes a second gear that is mechanically coupled to the first gear such that rotation of the first gear by the stepper motor rotates the rotatable docking port, and where the controller is configured to track the rotational position of the rotatable docking port using the position sensor. In addition, in some embodiments, the controller is configured to return the rotatable docking port to a predetermined rotational position when the keyed connector is disconnected from the rotatable docking port.

In some embodiments, the rotatable docking port includes a port connector configured to mate with the keyed connector when the rotatable docking port and the keyed connector are at the predetermined angular relationship, the keyed connector includes a first keying element disposed at a first angular position on the keyed connector and the port connector includes a second keying element disposed at a second angular position on the port connector, and the first and second keying elements are configured to engage one another to resist relative rotation between the keyed connector and the port connector when the rotatable docking port and the keyed connector are at the predetermined angular relationship and to permit relative rotation between the keyed connector and the port connector when the rotatable docking port and the keyed connector are not at the predetermined angular relationship. In addition, in some embodiments, the keyed connector includes a first mating surface, the port connector includes a second mating surface configured to oppose with the first mating surface when the rack is in the washing position, and the first and second keying elements are respectively disposed on the first and second mating surfaces proximate a first radius from an axis of rotation of the rotatable docking port and the rotatable conduit.

Moreover, in some embodiments, one of the first and second keying elements includes a projection that extends beyond the respective first or second mating surface, and the other of the first and second keying elements includes a recess disposed on the respective first or second mating surface. The recess is sized and configured to receive the projection when the keyed connector and the rotatable docking port are at the predetermined angular relationship. In some embodiments, the second mating surface is further movable along the axis of rotation and biased towards the keyed connector such that when the keyed connector and the rotatable docking port are not at the predetermined angular relationship the projection abuts the first or second mating surface upon which the recess is disposed.

Moreover, in some embodiments, the first mating surface includes an inlet port and the second mating surface includes an outlet port positioned opposite the inlet port when the keyed connector and the rotatable docking port are at the predetermined angular relationship to communicate fluid from the rotatable docking port to the rotatable conduit, and the rotatable docking port includes a seal configured to maintain a seal as the second mating surface moves along the axis of rotation. In some embodiments, the seal includes a bellows seal, a radial seal, face seal or an axial seal. In addition, in some embodiments, the projection includes a ramped surface. Further, in some embodiments, the first and second mating surfaces are generally transverse to the axis of rotation.

Moreover, in some embodiments, the keyed connector includes a third keying element disposed at a third angular position on the keyed connector and the port connector includes a fourth keying element disposed at a fourth angular position on the port connector, the third and fourth keying elements are configured to engage one another to resist relative rotation between the keyed connector and the port connector when the rotatable docking port and the keyed connector are at the predetermined angular relationship and to permit relative rotation between the keyed connector and the port connector when the rotatable docking port and the keyed connector are not at the predetermined angular relationship, the third and fourth keying elements are respectively disposed on the first and second mating surfaces proximate a second radius from an axis of rotation of the rotatable docking port and the rotatable conduit, and the first radius is different than the second radius. Also, in some embodiments, the projection is at least partially retractable into the respective first or second mating surface and is biased to an extended position that extends beyond the respective first or second mating surface.

In some embodiments, the keyed connector includes a first keying element disposed at a first angular position on the keyed connector and the rotatable docking port includes a second keying element disposed at a second angular position on the rotatable docking port, at least one of the first and second keying elements includes a magnet, and the first and second keying elements are configured to magnetically engage one another to resist relative rotation between the keyed connector and the rotatable docking port when the rotatable docking port and the keyed connector are at the predetermined angular relationship.

Consistent with another aspect of the invention, a dishwasher may include a wash tub, a rack supported in the wash tub and movable between loading and washing positions, a rotatable connector rotatably coupled to a wall of the wash tub to rotate about an axis of rotation and including a first keying element disposed at a predetermined angular position on the rotatable connector and separated from the axis of rotation by a predetermined radius, a rotatable conduit supported by the rack for movement with the rack and configured to rotate about the axis of rotation, and a keyed connector disposed at an end of the rotatable conduit facing the rotatable connector and including a second keying element disposed at a predetermined angular position on the keyed connector separated from the axis of rotation by the predetermined radius. In addition, the first and second keying elements are respectively positioned to mate with one another when the keyed connector is at a predetermined angular relationship to the rotatable connector when the rack is in the washing position.

Consistent with another aspect of the invention, a dishwasher may include a wash tub, a rotatable docking port coupled to a wall of the wash tub and in fluid communication with a fluid supply, the rotatable docking port being rotatable about an axis of rotation, a tubular spray element drive coupled to the rotatable docking port to rotate the rotatable docking port, a rack supported in the wash tub and movable between loading and washing positions, a tubular spray element supported by the rack for movement with the rack and rotatable about a longitudinal axis thereof, the tubular spray element including an inlet port configured to receive fluid from the rotatable docking port when the rack is in the washing position and one or more apertures extending through an exterior surface thereof to spray fluid received at the inlet port, a first coupling plate disposed on an end of the tubular spray element and having a first mating surface extending generally transverse to the axis of rotation and facing the rotatable docking port, a second coupling plate disposed on an end of the rotatable docking port and having a second mating surface extending generally transverse to the axis of rotation and facing the tubular spray element, where the second coupling plate is further movable along the axis of rotation and is biased toward the tubular spray element, a first projection disposed on the first coupling plate at a first angular position on the first coupling plate and at a first radius from the axis of rotation, the first projection extending from the first mating surface, a second projection disposed on the first coupling plate at a second angular position on the first coupling plate and at a second radius from the axis of rotation, the second projection extending from the first mating surface, and the second radius different from the first radius, a first recess disposed on the second coupling plate at a first angular position on the second coupling plate and at the first radius from the axis of rotation, the first recess extending into the second mating surface and sized and configured to receive the first projection when the first and second coupling plates are at a predetermined angular relationship to one another, a second recess disposed on the second coupling plate at a second angular position on the second coupling plate and at the second radius from the axis of rotation, the second recess extending into the second mating surface and sized and configured to receive the second projection when the first and second coupling plates are at the predetermined angular relationship to one another, and a controller coupled to the tubular spray element drive. The controller is configured to rotate the rotatable docking port a predetermined amount of rotation to ensure that the rotatable docking port rotates relative to the tubular spray element to establish the predetermined angular relationship between the first and second coupling plates and thereby cause the first and second projections to respectively engage with the first and second recesses, and the controller is further configured to thereafter rotate the rotatable docking port to discretely direct the tubular spray element to a predetermined rotational position.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

FIG. 15 is an enlarged perspective view illustrating an example implementation of the keyed coupling used in the example implementation of FIG. 13.

FIG. 16 illustrates another example coupling plate implementation suitable for use in some embodiments consistent with the invention.

FIG. 17 illustrates yet another example coupling plate implementation suitable for use in some embodiments consistent with the invention.

DETAILED DESCRIPTION

Figure 1:
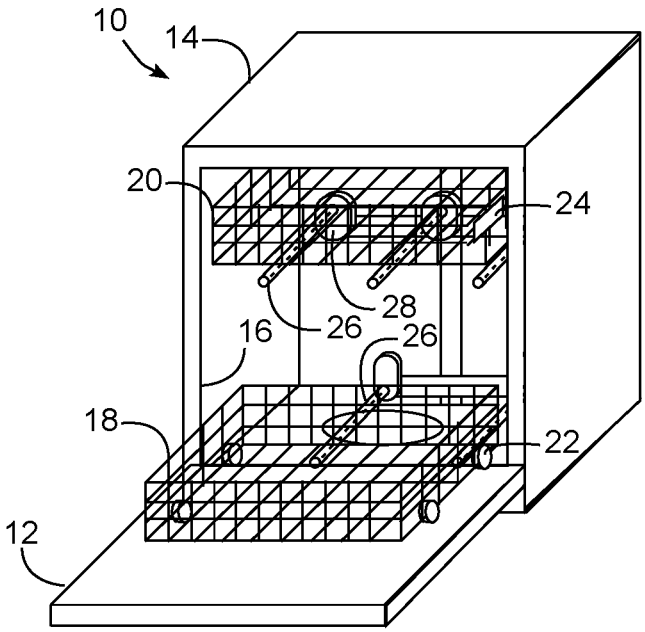
FIG. 1 is a perspective view of a dishwasher consistent with some embodiments of the invention.

In some embodiments consistent with the invention, one or more conduits supported by a dishwasher rack may be selectively docked with a wall-mounted docking arrangement including multiple and/or rotating docking ports, and including keyed couplings between the conduits and the wall-mounted docking arrangement to facilitate reestablishment of predetermined angular relationships between the conduits and the docking arrangement.

In particular, a predetermined angular relationship between a rotatable conduit and a rotatable docking port or other component of a docking arrangement may be considered to be established when the rotational position of the rotatable conduit about an axis of rotation is at a predetermined offset from the rotational position of the rotatable docking port or other component of the docking arrangement about that same axis of rotation. From a functional perspective, the predetermined angular relationship means that the rotational position of the rotatable conduit may be known to a controller of a dishwasher if the rotational position of the rotatable docking port or other component to which the rotatable conduit is coupled. As such, despite the fact that a rack-mounted rotatable conduit may be disengaged from a rotatable docking port as a result of movement of a rack from a washing position to a loading position, a keyed coupling as disclosed herein may be used to reestablish the predetermined angular relationship once the rack has been returned to its loading position.

A conduit, in this regard, may be considered to be a body capable of communicating a fluid such as water, a wash fluid including water, detergent and/or another treatment composition, or pressurized air. A conduit may communicate fluid to one or more spray elements supported by a rack in some embodiments, while in other embodiments, a conduit itself may include one or more apertures or nozzles such that the conduit also functions as a spray element to spray fluid onto utensils within a wash tub. One particular type of conduit utilized in some embodiments of the invention is referred to herein as a tubular spray element, which may be considered to include an elongated body, which may be generally cylindrical in some embodiments but may also have other cross-sectional profiles in other embodiments, and which has one or more apertures disposed on an exterior surface thereof and in fluid communication with a fluid supply, e.g., through one or more internal passageways defined therein. A tubular spray element also has a longitudinal axis generally defined along its longest dimension and about which the tubular spray element rotates. Further, when a tubular spray element is mounted on a rack and configured to selectively engage with a dock based upon the position of the rack, this longitudinal axis may also be considered to be an axis of insertion. A tubular spray element may also have a cross-sectional profile that varies along the longitudinal axis, so it will be appreciated that a tubular spray element need not have a circular cross-sectional profile along its length as is illustrated in a number embodiments herein. In addition, the one or more apertures on the exterior surface of a tubular spray element may be arranged into nozzles in some embodiments, and may be fixed or movable (e.g., rotating, oscillating, etc.) with respect to other apertures on the tubular spray element. Further, the exterior surface of a tubular spray element may be defined on multiple components of a tubular spray element, i.e., the exterior surface need not be formed by a single integral component.

In addition, in some embodiments a tubular spray element may be discretely directed by a tubular spray element drive to multiple rotational positions about the longitudinal axis to spray a fluid in predetermined directions into a wash tub of a dishwasher during a wash cycle. In some embodiments, the tubular spray element may be operably coupled to such a drive through a docking arrangement that both rotates the tubular spray element and supplies fluid to the tubular spray element, as will become more apparent below. Further details regarding tubular spray elements may be found, for example, in U.S. Ser. No. 15/721,099, filed on Sep. 29, 2017 by Robert M. Digman et al. (hereinafter, the "first cross-referenced application"), as well as U.S. Ser. No. 16/132,125 filed on Sep. 14, 2018 by Robert M. Digman et al. (hereinafter, the "second cross-referenced application"), both of which are incorporated by reference herein.

Thus, from the perspective of a rack-mounted tubular spray element, an ability to reestablish a predetermined angular relationship between a tubular spray element and a rotatable dock or other component controlled by a tubular spray element drive effectively means that whenever a rack is returned to a washing position (e.g., after the dishwasher has been loaded and a wash cycle is started, or after a wash cycle has been paused and resumed, the direction in which the nozzles or apertures in the tubular spray element will direct their spray may be determined based upon a known rotational position of the rotatable docking port or other component.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle.

In addition, consistent with some embodiments of the invention, dishwasher 10 may include one or more tubular spray elements (TSEs) 26 to direct a wash fluid onto utensils disposed in racks 18, 20. As will become more apparent below, tubular spray elements 26 are rotatable about respective longitudinal axes and are discretely directable by one or more tubular spray element drives (not shown in FIG. 1) to control a direction at which fluid is sprayed by each of the tubular spray elements. In some embodiments, fluid may be dispensed solely through tubular spray elements, however the invention is not so limited. For example, in some embodiments various upper and/or lower rotating spray arms may also be provided to direct additional fluid onto utensils. Still other sprayers, including various combinations of wall-mounted sprayers, rack-mounted sprayers, oscillating sprayers, fixed sprayers, rotating sprayers, focused sprayers, etc., may also be combined with one or more tubular spray elements in some embodiments of the invention.

Some tubular spray elements 26 may be fixedly mounted to a wall or other structure in wash tub 16, e.g., as may be the case for tubular spray elements 26 disposed below or adjacent lower rack 18. For other tubular spray elements 26, e.g., rack-mounted tubular spray elements, the tubular spray elements may be removably coupled to a docking arrangement such as docking arrangement 28 mounted to the rear wall of wash tub 16 in FIG. 1. Further details regarding docking arrangement 28 will be discussed below.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

Figure 2:
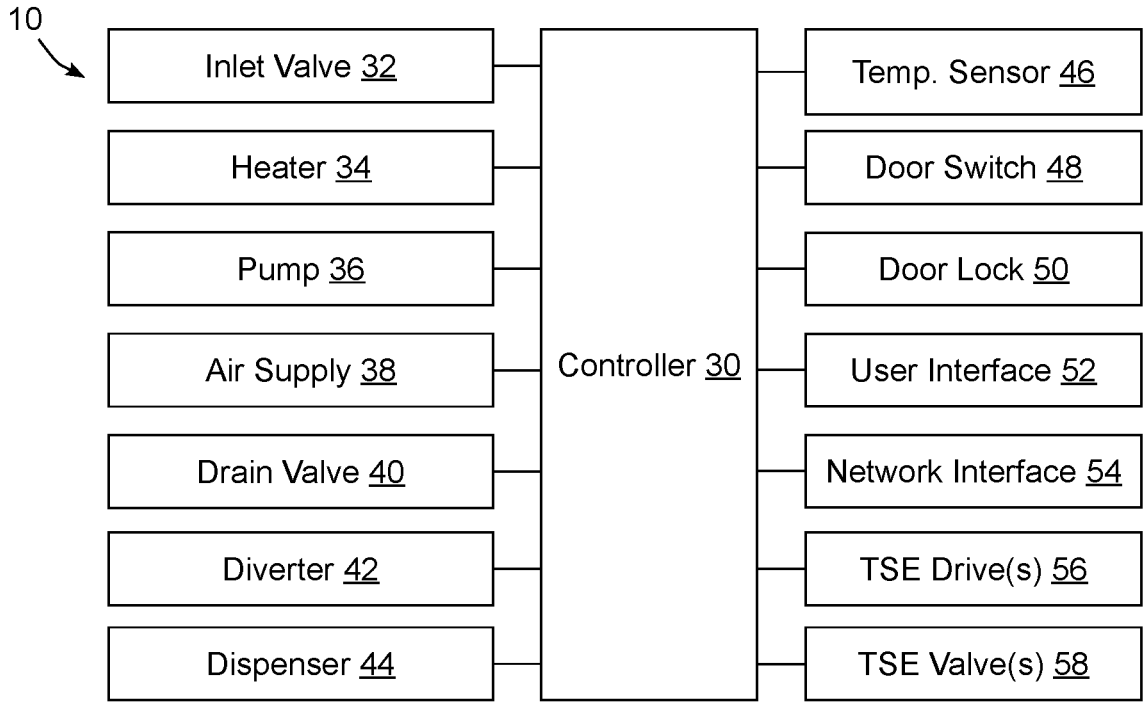
FIG. 2 is a block diagram of an example control system for the dishwasher of FIG. 1.

Now turning to FIG. 2, dishwasher 10 may be under the control of a controller 30 that receives inputs from a number of components and drives a number of components in response thereto. Controller 30 may, for example, include one or more processors and a memory (not shown) within which may be stored program code for execution by the one or more processors. The memory may be embedded in controller 30, but may also be considered to include volatile and/or non-volatile memories, cache memories, flash memories, programmable read-only memories, read-only memories, etc., as well as memory storage physically located elsewhere from controller 30, e.g., in a mass storage device or on a remote computer interfaced with controller 30.

As shown in FIG. 2, controller 30 may be interfaced with various components, including an inlet valve 32 that is coupled to a water source to introduce water into wash tub 16, which when combined with detergent, rinse agent and/or other additives, forms various wash fluids. Controller may also be coupled to a heater 34 that heats fluids, a pump 36 that recirculates wash fluid within the wash tub by pumping fluid to the wash arms and other spray devices in the dishwasher, an air supply 38 that provides a source of pressurized air for use in drying utensils in the dishwasher, a drain valve 40 that is coupled to a drain to direct fluids out of the dishwasher, and a diverter 42 that controls the routing of pumped fluid to different tubular spray elements, spray arms and/or other sprayers during a wash cycle. In some embodiments, a single pump 36 may be used, and drain valve 40 may be configured to direct pumped fluid either to a drain or to the diverter 42 such that pump 36 is used both to drain fluid from the dishwasher and to recirculate fluid throughout the dishwasher during a wash cycle. In other embodiments, separate pumps may be used for draining the dishwasher and recirculating fluid. Diverter 42 in some embodiments may be a passive diverter that automatically sequences between different outlets, while in some embodiments diverter 42 may be a powered diverter that is controllable to route fluid to specific outlets on demand. In still other embodiments, and as will be discussed in greater detail below, each tubular spray element may be separately controlled such that no separate diverter is used. Air supply 38 may be implemented as an air pump or fan in different embodiments, and may include a heater and/or other air conditioning device to control the temperature and/or humidity of the pressurized air output by the air supply.

In the illustrated embodiment, pump 36 and air supply 38 collectively implement a fluid supply for dishwasher 100, providing both a source of wash fluid and pressurized air for use respectively during wash and drying operations of a wash cycle. A wash fluid may be considered to be a fluid, generally a liquid, incorporating at least water, and in some instances, additional components such as detergent, rinse aid, and other additives. During a rinse operation, for example, the wash fluid may include only water. A wash fluid may also include steam in some instances. Pressurized air is generally used in drying operations, and may or may not be heated and/or dehumidified prior to spraying into a wash tub. It will be appreciated, however, that pressurized air may not be used for drying purposes in some embodiments, so air supply 38 may be omitted in some instances. Moreover, in some instances, tubular spray elements may be used solely for spraying wash fluid or spraying pressurized air, with other sprayers or spray arms used for other purposes, so the invention is not limited to the use of tubular spray elements for spraying both wash fluid and pressurized air.

Controller 30 may also be coupled to a dispenser 44 to trigger the dispensing of detergent and/or rinse agent into the wash tub at appropriate points during a wash cycle. Additional sensors and actuators may also be used in some embodiments, including a temperature sensor 46 to determine a wash fluid temperature, a door switch 48 to determine when door 12 is latched, and a door lock 50 to prevent the door from being opened during a wash cycle. Moreover, controller 30 may be coupled to a user interface 52 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 30 may also be coupled to one or more network interfaces 54, e.g., for interfacing with external devices via wired and/or wireless networks such as Ethernet, Bluetooth, NFC, cellular and other suitable networks. Additional components may also be interfaced with controller 30, as will be appreciated by those of ordinary skill having the benefit of the instant disclosure. For example, one or more tubular spray element (TSE) drives 56 and/or one or more tubular spray element (TSE) valves 58 may be provided in some embodiments to discretely control one or more tubular spray elements disposed in dishwasher 10, as will be discussed in greater detail below.

It will be appreciated that each tubular spray element drive 56 may also provide feedback to controller 30 in some embodiments, e.g., a current position and/or speed, although in other embodiments a separate position sensor may be used. In addition, as will become more apparent below, flow regulation to a tubular spray element may be performed without the use of a separately-controlled tubular spray element valve 58 in some embodiments, e.g., where rotation of a tubular spray element by a tubular spray element drive is used to actuate a mechanical valve.

Moreover, in some embodiments, at least a portion of controller 30 may be implemented externally from a dishwasher, e.g., within a mobile device, a cloud computing environment, etc., such that at least a portion of the functionality described herein is implemented within the portion of the controller that is externally implemented. In some embodiments, controller 30 may operate under the control of an operating system and may execute or otherwise rely upon various computer software applications, components, programs, objects, modules, data structures, etc. In addition, controller 30 may also incorporate hardware logic to implement some or all of the functionality disclosed herein. Further, in some embodiments, the sequences of operations performed by controller 30 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher illustrated in FIGS. 1-2 will be apparent to one of ordinary skill in the art, as will become apparent from the description below. Therefore, the invention is not limited to the specific implementations discussed herein.

Figure 3:
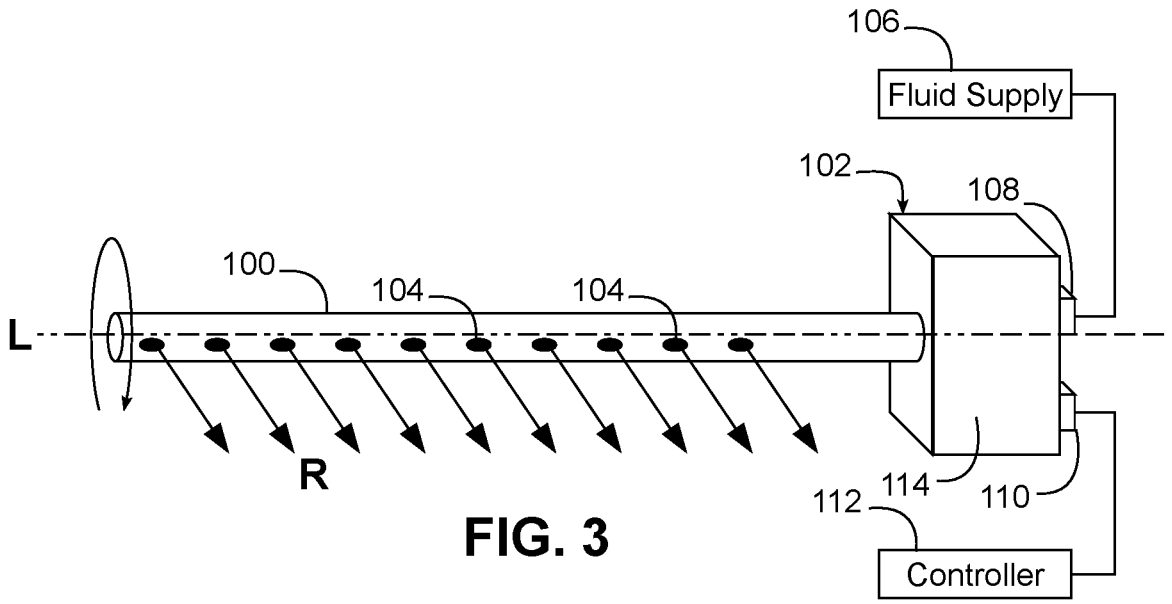
FIG. 3 is a side perspective view of a tubular spray element and tubular spray element drive from the dishwasher of FIG. 1.

Now turning to FIG. 3, in some embodiments, a dishwasher may include one or more discretely directable tubular spray elements, e.g., tubular spray element 100 coupled to a tubular spray element drive 102. Tubular spray element 100 may be configured as a tube or other elongated body disposed in a wash tub and being rotatable about a longitudinal axis L. In addition, tubular spray element 100 is generally hollow or at least includes one or more internal fluid passages that are in fluid communication with one or more apertures 104 extending through an exterior surface thereof. Each aperture 104 may function to direct a spray of fluid into the wash tub, and each aperture may be configured in various manners to provide various types of spray patterns, e.g., streams, fan sprays, concentrated sprays, etc. Apertures 104 may also in some instances be configured as fluidic nozzles providing oscillating spray patterns.

Moreover, as illustrated in FIG. 3, apertures 104 may all be positioned to direct fluid along a same radial direction from axis L, thereby focusing all fluid spray in generally the same radial direction represented by arrows R. In other embodiments, however, apertures may be arranged differently about the exterior surface of a tubular spray element, e.g., to provide spray from two, three or more radial directions, to distribute a spray over one or more arcs about the circumference of the tubular spray element, etc.

Tubular spray element 100 is in fluid communication with a fluid supply 106, e.g., through a port 108 of tubular spray element drive 102, to direct fluid from the fluid supply into the wash tub through the one or more apertures 104. Tubular spray element drive 102 is coupled to tubular spray element 100 and is configured to discretely direct the tubular spray element 100 to each of a plurality of rotational positions about longitudinal axis L. By "discretely directing," what is meant is that tubular spray element drive 102 is capable of rotating tubular spray element 100 generally to a controlled rotational angle (or at least within a range of rotational angles) about longitudinal axis L. Thus, rather than uncontrollably rotating tubular spray element 100 or uncontrollably oscillating the tubular spray element between two fixed rotational positions, tubular spray element drive 102 is capable of intelligently focusing the spray from tubular spray element 100 between multiple rotational positions. It will also be appreciated that rotating a tubular spray element to a controlled rotational angle may refer to an absolute rotational angle (e.g., about 10 degrees from a home position) or may refer to a relative rotational angle (e.g., about 10 degrees from the current position).

Tubular spray element drive 102 is also illustrated with an electrical connection 110 for coupling to a controller 112, and a housing 114 is illustrated for housing various components in tubular spray element drive 102 that will be discussed in greater detail below. In the illustrated embodiment, tubular spray element drive 102 is configured as a base that supports, through a rotary coupling, an end of the tubular spray element and effectively places the tubular spray element in fluid communication with port 108.

By having an intelligent control provided by tubular spray element drive 102 and/or controller 112, spray patterns and cycle parameters may be increased and optimized for different situations. For instance, tubular spray elements near the center of a wash tub may be configured to rotate 360 degrees, while tubular spray elements located near wash tub walls may be limited to about 180 degrees of rotation to avoid spraying directly onto any of the walls of the wash tub, which can be a significant source of noise in a dishwasher. In another instance, it may be desirable to direct or focus a tubular spray element to a fixed rotational position or over a small range of rotational positions (e.g., about 5-10 degrees) to provide concentrated spray of liquid, steam and/or air, e.g., for cleaning silverware or baked on debris in a pan. In addition, in some instances the rotational velocity of a tubular spray element could be varied throughout rotation to provide longer durations in certain ranges of rotational positions and thus provide more concentrated washing in particular areas of a wash tub, while still maintaining rotation through 360 degrees. Control over a tubular spray element may include control over rotational position, speed or rate of rotation and/or direction of rotation in different embodiments of the invention.

Figure 4:
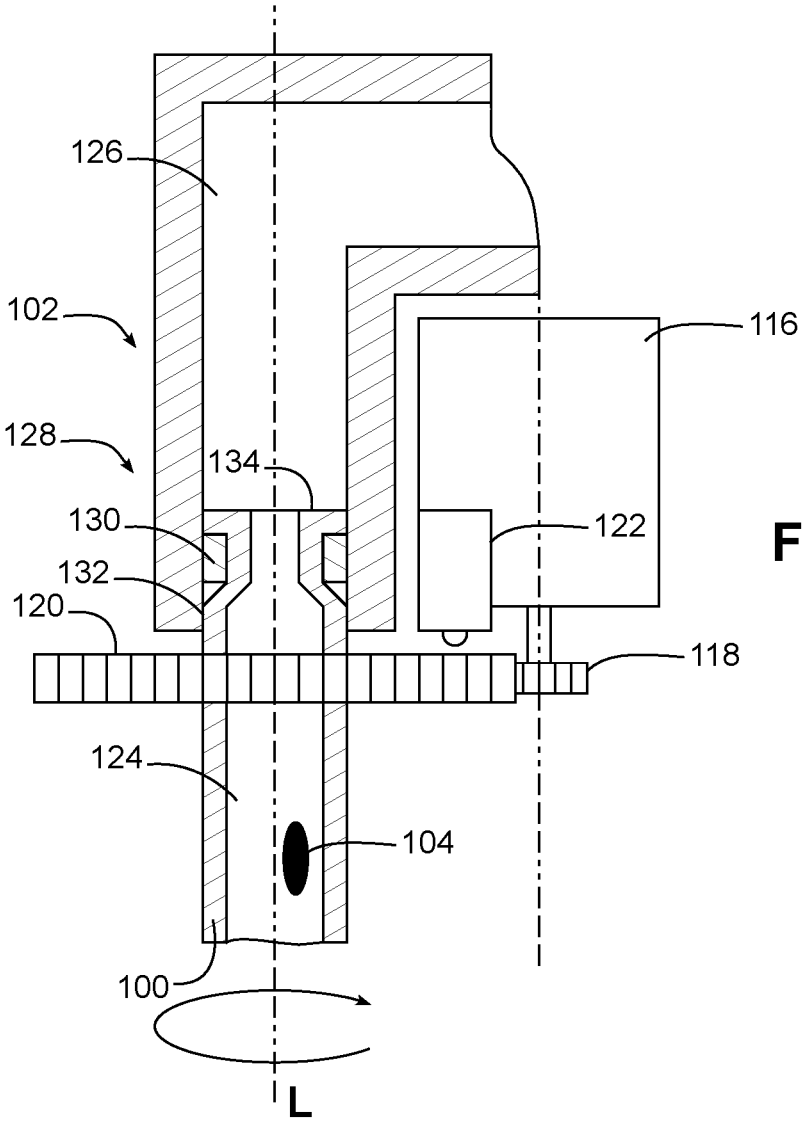
FIG. 4 is a partial cross-sectional view of the tubular spray element and tubular spray element drive of FIG. 3.

FIG. 4 illustrates one example implementation of tubular spray element 100 and tubular spray element drive 102 in greater detail, with housing 114 omitted for clarity. In this implementation, tubular spray element drive 102 includes an electric motor 116, which may be an alternating current (AC) or direct current (DC) motor, e.g., a brushless DC motor, a stepper motor, etc., which is mechanically coupled to tubular spray element 100 through a gearbox including a pair of gears 118, 120 respectively coupled to motor 116 and tubular spray element 100. Other manners of mechanically coupling motor 116 to tubular spray element 100 may be used in other embodiments, e.g., different numbers and/or types of gears, belt and pulley drives, magnetic drives, hydraulic drives, linkages, friction, etc.

In addition, an optional position sensor 122 may be disposed in tubular spray element drive 102 to determine a rotational position of tubular spray element 100 about axis L. Position sensor 122 may be an encoder or hall sensor in some embodiments, or may be implemented in other manners, e.g., integrated into a stepper motor, whereby the rotational position of the motor is used to determine the rotational position of the tubular spray element, or using one or more microswitches and a cam configured to engage the microswitches at predetermined rotational positions. Position sensor 122 may also sense only limited rotational positions about axis L (e.g., a home position, 30 or 45 degree increments, etc.). Further, in some embodiments, rotational position may be controlled using time and programming logic, e.g., relative to a home position, and in some instances without feedback from a motor or position sensor. Position sensor 122 may also be external to tubular spray element drive 102 in some embodiments.

An internal passage 124 in tubular spray element 100 is in fluid communication with an internal passage 126 leading to port 108 (not shown in FIG. 4) in tubular spray element drive 102 through a rotary coupling 128. In one example implementation, coupling 128 is formed by a bearing 130 mounted in passageway 126, with one or more deformable tabs 134 disposed at the end of tubular spray element 100 to secure tubular spray element 100 to tubular spray element drive 102. A seal 132, e.g., a lip seal, may also be formed between tubular spray element 100 and tubular spray element drive 102. Other manners of rotatably coupling the tubular spray element while providing fluid flow may be used in other embodiments.

Figure 5:
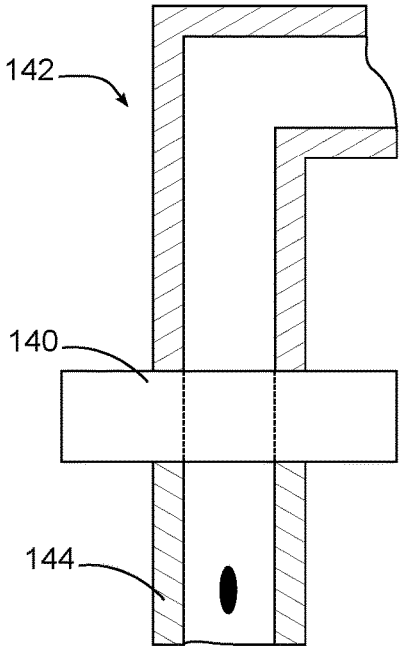
FIG. 5 is a partial cross-sectional view of another tubular spray element and tubular spray element drive consistent with some embodiments of the invention, and including a valve for restricting flow to the tubular spray element.

Turning to FIG. 5, it also may be desirable in some embodiments to incorporate a valve 140 into a tubular spray element drive 142 to regulate the fluid flow to a tubular spray element 144 (other elements of drive 142 have been omitted from FIG. 5 for clarity). Valve 140 may be an on/off valve in some embodiments or may be a variable valve to control flow rate in other embodiments. In still other embodiments, a valve may be external to or otherwise separate from a tubular spray element drive, and may either be dedicated to the tubular spray element or used to control multiple tubular spray elements. Valve 140 may be integrated with or otherwise proximate a rotary coupling between tubular spray element 144 and tubular spray element drive 142. By regulating fluid flow to tubular spray elements, e.g., by selectively shutting off tubular spray elements, water can be conserved and/or high-pressure zones can be created by pushing all of the hydraulic power through fewer numbers of tubular spray elements.

In some embodiments, valve 140 may be actuated independent of rotation of tubular spray element 144, e.g., using an iris valve, butterfly valve, gate valve, plunger valve, piston valve, valve with a rotatable disk, ball valve, etc., and actuated by a solenoid, motor or other separate mechanism from the mechanism that rotates tubular spray element 144. In other embodiments, however, valve 140 may be actuated through rotation of tubular spray element 144. In some embodiments, for example, rotation of tubular spray element 144 to a predetermined rotational position may be close valve 140, e.g., where valve 140 includes an arcuate channel that permits fluid flow over only a range of rotational positions.

Figure 6:
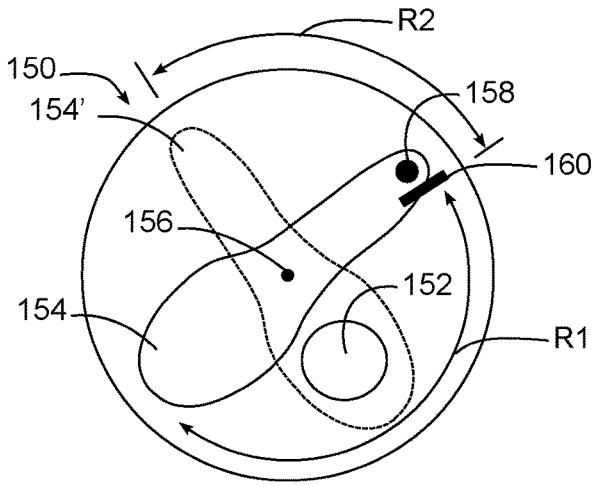
FIG. 6 is one example implementation of the valve referenced in FIG. 5.

As another example, and as illustrated by valve 150 of FIG. 6, a valve may be actuated through over-rotation of a tubular spray element. Valve 150, for example, includes a port 152 that is selectively shut by a gate 154 that pivots about a pin 156. Gate 154 is biased (e.g., via a spring) to the position shown via solid line in FIG. 6, and includes a leg 158 that selectively engages a stop 160 at a predetermined rotational position representing an end of a range R1 of active spray positions for the tubular spray element. When a tubular spray element is rotated beyond range R1, e.g., within range R2, leg 158 engages with stop 160 to pivot gate 154 to the position 154' shown in dotted line and seal port 152.

Figure 7:
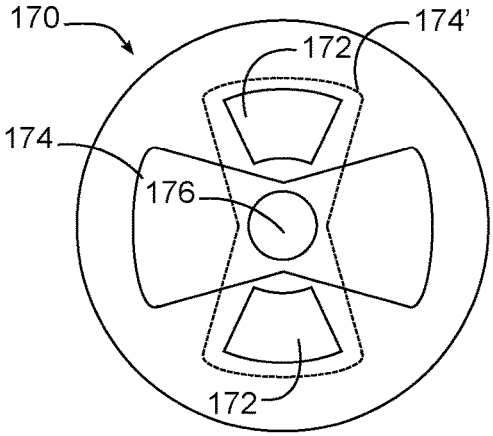
FIG. 7 is another example implementation of the valve referenced in FIG. 5.

As yet another example, and as illustrated by valve 170 of FIG. 7, a valve may be actuated through counter rotation of a tubular spray element. Valve 170, for example, includes a pair of ports 172 that are selectively shut by a gate 174 that pivots about a one way bearing 176. Gate 174 is biased (e.g., via a spring) to the position shown via solid line in FIG. 7, and when the tubular spray element is rotated in a clockwise direction, gate 174 is maintained in a position that permits fluid flow through ports 172. Upon counter-clockwise rotation, however, gate 174 is rotated to position 174' shown in dotted line to seal ports 172 through the action of one way bearing 176.

Figure 8:
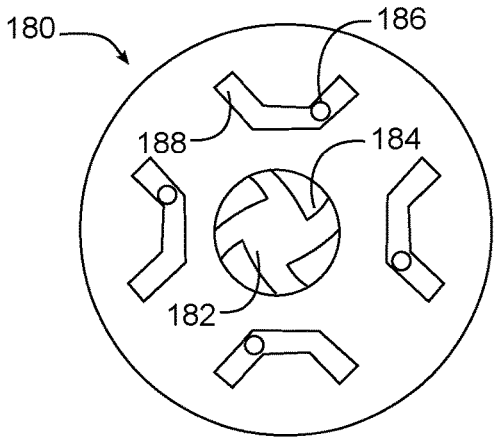
FIG. 8 is yet another first example implementation of the valve referenced in FIG. 5.

As yet another example, and as illustrated by valve 180 of FIG. 8, a valve 180 may be a variable valve, e.g., an iris valve, including a port 182 that is selectively regulated by a plurality of iris members 184. Each iris member 184 includes a pin 186 that rides in a track 188 to vary an opening size of port 182. Valve 180 may be independently actuated from rotation of a tubular spray element in some embodiments (e.g., via a solenoid or motor), or may be actuated through rotation of a tubular spray element, e.g., through rotation to a predetermined position, an over-rotation, or a counter-rotation, using appropriate mechanical linkages.

It should also be noted that with the generally U-shape of track 188, valve 180 may be configured in some embodiments to close through counter-rotation by a predetermined amount, yet still remain open when rotated in both directions. Specifically, valve 180 may be configured such that, the valve is open when pin 186 is disposed in either leg of the U-shaped track, but is closed when pin 186 is disposed in the central portion of the track having the shortest radial distance from the centerline of the valve. Valve 180 may be configured such that, when the tubular spray element is rotating in one direction and pin 186 is disposed at one end of track 188, the valve is fully open, and then when the tubular spray element is counter-rotated in an opposite direction a first predetermined amount (e.g., a predetermined number of degrees) the pin 186 travels along track 188 to the central portion to fully close the valve. Then, when the tubular spray element is counter-rotated in the opposite direction beyond the first predetermined about, the pin 186 continues to travel along track 188 to the opposite end, thereby reopening the valve such that the valve will remain open through continued rotation in the opposite direction.

Figure 9:
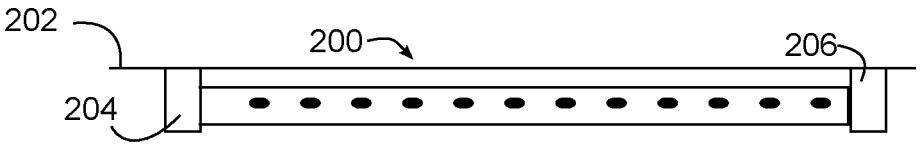
FIG. 9 is a functional top plan view of an example implementation of a wall-mounted tubular spray element and tubular spray element drive consistent with some embodiments of the invention.
Figure 10:
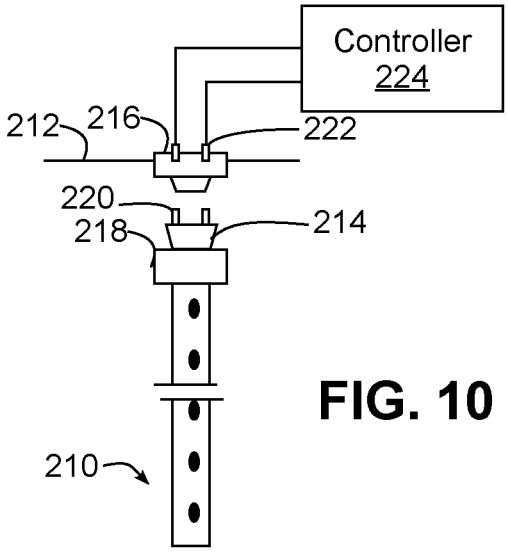
FIG. 10 is a functional top plan view of an example implementation of a rack-mounted tubular spray element and tubular spray element drive consistent with some embodiments of the invention.
Figure 11:
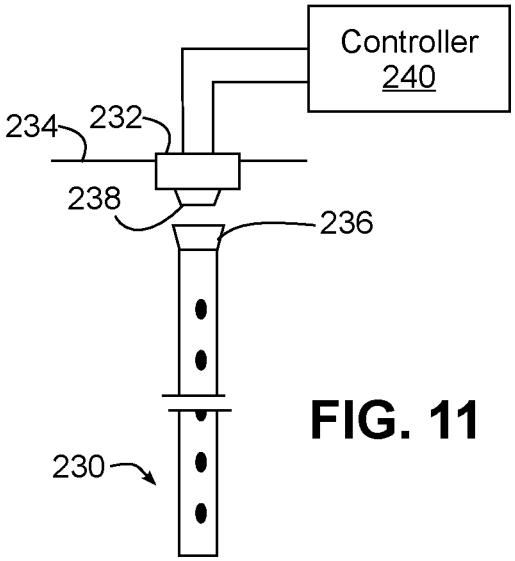
FIG. 11 is a functional top plan view of another example implementation of a rack-mounted tubular spray element and tubular spray element drive consistent with some embodiments of the invention.

Now turning to FIGS. 9-11, tubular spray elements may be mounted within a wash tub in various manners in different embodiments. As illustrated by FIGS. 1 and 3 (discussed above), a tubular spray element in some embodiments may be mounted to a wall (e.g., a side wall, a back wall, a top wall, a bottom wall, or a door) of a wash tub, and may be oriented in various directions, e.g., horizontally, vertically, front-to-back, side-to-side, or at an angle. It will also be appreciated that a tubular spray element drive may be disposed within a wash tub, e.g., mounted on wall of the wash tub or on a rack or other supporting structure, or alternatively some or all of the tubular spray element drive may be disposed external from a wash tub, e.g., such that a portion of the tubular spray element drive or the tubular spray element projects through an aperture in the wash tub. Alternatively, a magnetic drive could be used to drive a tubular spray element in the wash tub using an externally-mounted tubular spray element drive.

Moreover, as illustrated by tubular spray element 200 of FIG. 9, rather than being mounted in a cantilevered fashion as is the case with tubular spray element 100 of FIG. 3, a tubular spray element may also be mounted on a wall 202 of a wash tub and supported at both ends by hubs 204, 206, one or both of which may include the components of the tubular spray element drive. In this regard, the tubular spray element 200 runs generally parallel to wall 202 rather than running generally perpendicular thereto, as is the case with tubular spray element 100 of FIG. 3.

In still other embodiments, a tubular spray element may be rack-mounted. FIG. 10, for example, illustrates a tubular spray element 210 mountable on rack (not shown) and dockable via a dock 214 to a docking port 216 on a wall 212 of a wash tub. In this embodiment, a tubular spray element drive 218 is also rack-mounted, and as such, in addition to a fluid coupling between dock 214 and docking port 216, a plurality of cooperative contacts 220, 222 are provided on dock 214 and docking port 216 to provide power to tubular spray element drive 218 as well as electrical communication with a controller 224.

As an alternative, and as illustrated in FIG. 11, a tubular spray element 230 may be rack-mounted, but separate from a tubular spray element drive 232 that is not rack-mounted, but is instead mounted to a wall 234 of a wash tub. A dock 236 and docking port 238 provide fluid communication with tubular spray element 230, along with a capability to rotate tubular spray element 230 about its longitudinal axis under the control of tubular spray element drive 232. Control over tubular spray element drive 232 is provided by a controller 240. In some instances, tubular spray element drive 232 may include a rotatable and keyed channel into which an end of a tubular spray element may be received.

Figure 12:
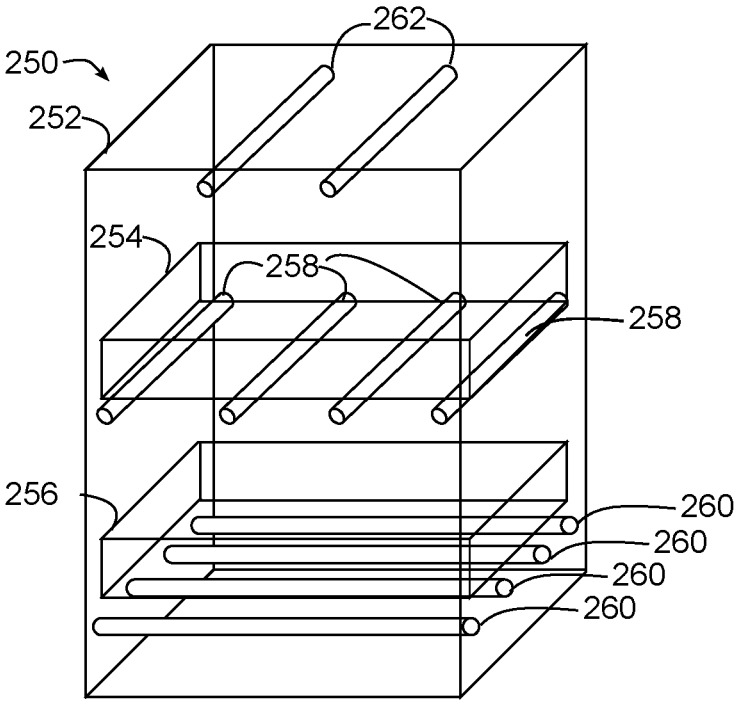
FIG. 12 is a functional perspective view of a dishwasher incorporating multiple tubular spray elements and consistent with some embodiments of the invention.

FIG. 12 next illustrates a dishwasher 250 including a wash tub 252 and upper and lower racks 254, 256, and with a number of tubular spray elements 258, 260, 262 distributed throughout the wash tub 252 for circulating a wash fluid through the dishwasher. Tubular spray elements 258 may be rack-mounted, supported on the underside of upper rack 254, and extending back-to-front within wash tub 252. Tubular spray elements 258 may also dock with back wall-mounted tubular spray element drives (not shown in FIG. 12), e.g., as discussed above in connection with FIG. 11. In addition, tubular spray elements 258 may be rotatably supported at one or more points along their respective longitudinal axes by couplings (not shown) suspended from upper rack 254. Tubular spray elements 258 may therefore spray upwardly into upper rack 254 and/or downwardly onto lower rack 256, and in some embodiments, may be used to focus wash fluid onto a silverware basket or other region of either rack to provide for concentrated washing. Tubular spray elements 260 may be wall-mounted beneath lower rack 256, and may be supported at both ends on the side walls of wash tub 252 to extend in a side-to-side fashion, and generally transverse to tubular spray elements 258. Each tubular spray element 258, 260 may have a separate tubular spray element drive in some embodiments, while in other embodiments some or all of the tubular spray elements 258, 260 may be mechanically linked and driven by common tubular spray element drives.

In some embodiments, tubular spray elements 258, 260 by themselves may provide sufficient washing action and coverage. In other embodiments, however, additional tubular spray elements, e.g., tubular spray elements 262 supported above upper rack 254 on one or both of the top and back walls of wash tub 252, may also be used. In addition, in some embodiments, additional spray arms and/or other sprayers may be used. It will also be appreciated that while 10 tubular spray elements are illustrated in FIG. 12, greater or fewer numbers of tubular spray elements may be used in other embodiments.

It will also be appreciated that in some embodiments, multiple tubular spray elements may be driven by the same tubular spray element drive, e.g., using geared arrangements, belt drives, or other mechanical couplings. Further, tubular spray elements may also be movable in various directions in addition to rotating about their longitudinal axes, e.g., to move transversely to a longitudinally axis, to rotate about an axis of rotation that is transverse to a longitudinal axis, etc. In addition, deflectors may be used in combination with tubular spray elements in some embodiments to further the spread of fluid and/or prevent fluid from hitting tub walls. In some embodiments, deflectors may be integrated into a rack, while in other embodiments, deflectors may be mounted to a wall of the wash tub. In addition, deflectors may also be movable in some embodiments, e.g., to redirect fluid between multiple directions. Moreover, while in some embodiments tubular spray elements may be used solely to spray wash fluid, in other embodiments tubular spray elements may be used to spray pressurized air at utensils during a drying operation of a wash cycle, e.g., to blow off water that pools on cups and dishes after rinsing is complete. In some instances, different tubular spray elements may be used to spray wash fluid and spray pressurized air, while in other instances the same tubular spray elements may be used to alternately or concurrently spray wash liquid and pressurized air.

Figure 13:
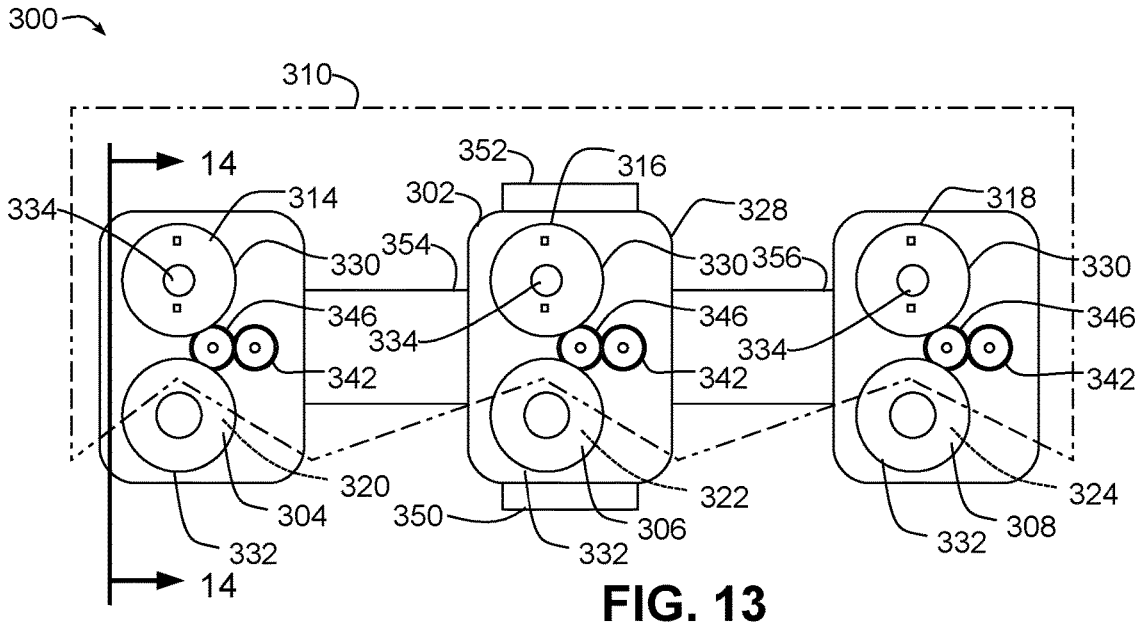
FIG. 13 is a front elevational view of an example implementation of rack-mounted tubular spray elements docked to a docking arrangement consistent with some embodiments of the invention.
Figure 14:
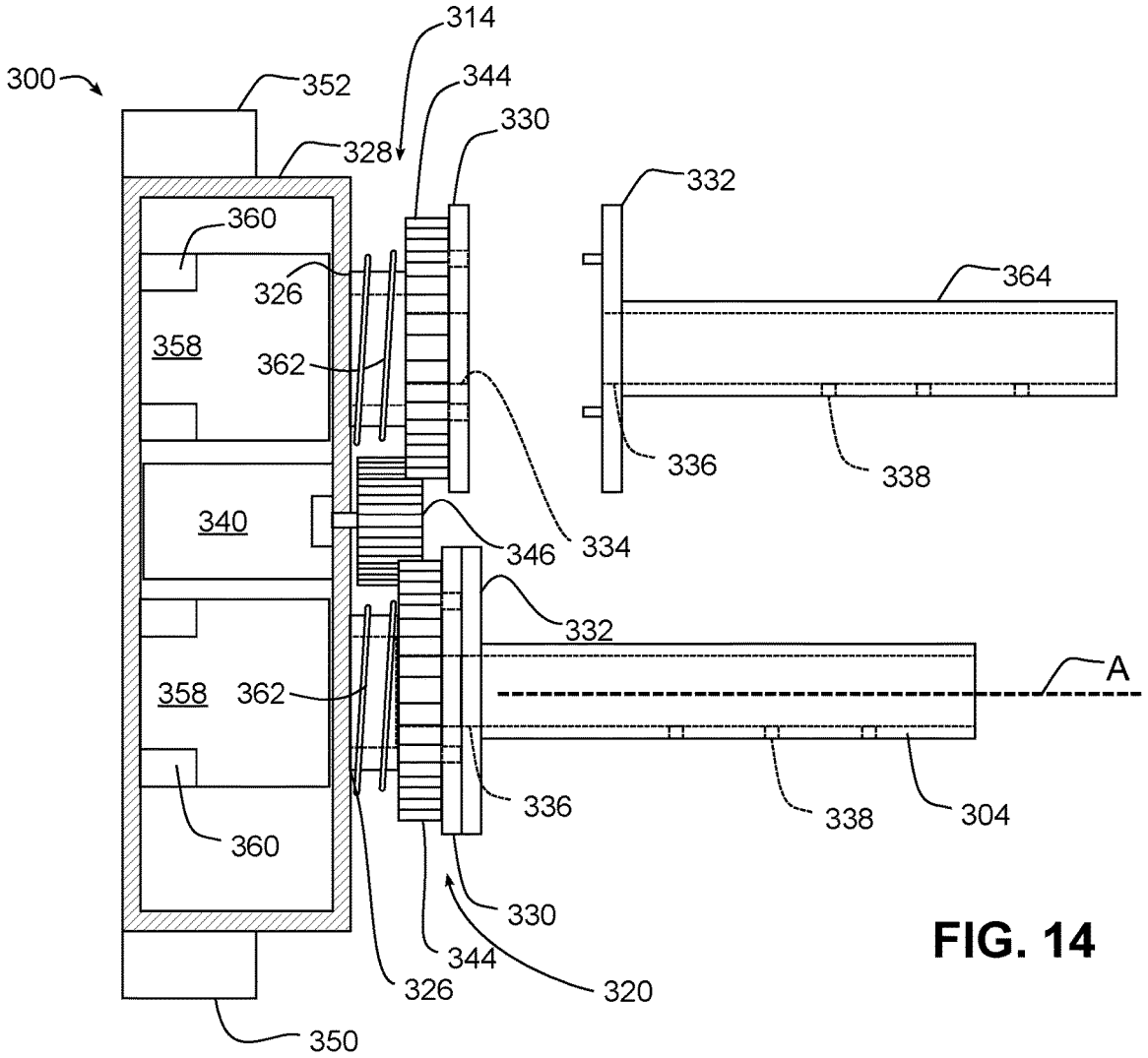
FIG. 14 is a cross-sectional view of the example implementation of FIG. 13, taken along lines 14-14 thereof.

Now turning to FIGS. 13-15, these figures illustrate an example rack-mounted tubular spray element system 300 suitable for use, for example, in dishwasher 10 of FIG. 1. Tubular spray element system 300 includes a docking arrangement 302 supporting docking with three rack-mounted tubular spray elements 304, 306, 308 rotatably supported on a rack 310 (illustrated in phantom) by a rack mount (not shown in FIG. 13). Tubular spray elements 304 and 308 will hereafter be referred to as side tubular spray elements as they are disposed toward the left and right sides of rack 310, while tubular spray element 306 will hereinafter be referred to as a central tubular spray element as it is disposed more centrally on rack 310. As will be discussed in greater detail below, rack mount 312 may include one or more keyed couplings to engage each tubular spray element 306, 308, 310 with a predetermined angular relationship to a corresponding docking port (and through a known gear ratio, an associated tubular spray element drive) in docking arrangement 302. Furthermore, multiple rack mounts may be used in some embodiments to support each tubular spray element 304-308 at multiple points along the longitudinal axes thereof.

In the illustrated embodiment, docking arrangement 302 includes multiple docking ports for each tubular spray element to support adjustment of rack 310 at multiple elevations in the wash tub, i.e., upper docking ports 314, 316, 318 and lower docking ports 320, 322, 324. In particular, in many dishwasher designs, it is desirable to enable a consumer to raise and lower the elevation of an upper rack in order to support different types of loads, e.g., where larger items need to be placed in the lower or upper rack. Various manners of adjusting the elevation of a rack may be used in different embodiments, as will be appreciated by those of ordinary skill in the art having the benefit of the instant disclosure. For the purposes of this example, it can be assumed that rack 310 includes suitable mechanisms to move the rack between an upper elevation where tubular spray elements 304-308 are received in upper docking ports 314-318, and a lower elevation where tubular spray elements 304-308 are received in lower docking ports 320-324.

Also in the illustrated embodiment, each docking port 314-324 is rotatable about an axis of insertion of its respective tubular spray element (e.g., axis A of FIG. 14 for tubular spray element 304). Axis A may therefore be considered to additionally be an axis of rotation of both the docking port and its respective tubular spray element. In addition, axis A may also be considered to be a longitudinal axis for tubular spray element 304, although it will be appreciated that the longitudinal axis of a tubular spray element, the axis of insertion of the tubular spray element, the axis of rotation of the tubular spray element and the axis of rotation of the docking port need not all be coextensive with one another in other embodiments.

Each docking port 314-324 is rotatably received in a circular aperture 326 in a housing 328 that is secured to a rear wall of the wash tub. Furthermore, each docking port 314-324 includes a coupling plate 330 configured in some embodiments as a disk and configured to engage with a corresponding disk-shaped coupling plate 332 on each tubular spray element 304-308 such that rotation of a docking port 314-324 causes rotation of the respective tubular spray element when connector coupling plates 330, 332 are engaged with one another in a predetermined angular relationship.

Furthermore, each docking port 314-324 includes one or more outlet ports 334 output fluid to an inlet port 336 of a tubular spray element 304-308 to receive fluid from docking arrangement 302 such that the fluid is conveyed through the tubular spray element and out of one or more apertures or nozzles 338 along the surface of the tubular spray element.

Rotation of each docking port may be implemented using a docking port drive, or tubular spray element drive, which in the illustrated embodiment comprises a stepper motor 340, one of which is illustrated in FIG. 14. Coupled to a drive shaft of each stepper motor 340 is a pinion gear 342 that is configured to drive a gear 344 formed on the outside surface of each docking port 314-324 such that one docking port drive is capable of concurrently driving both the upper and lower docking ports for a particular tubular spray element. An idler gear 346 may also be used in some embodiments to balance the load on each pinion gear 342 such that pinion gear 342 is mechanically coupled to each gear 344 through the idler gear 346.

As such, a total of three docking port drives are used for docking arrangement 302, thereby supporting individual control over the rotational position of each tubular spray element regardless of whether it is docked in the upper docking port or lower docking port. In other embodiments, one docking port drive may be coupled to drive multiple tubular spray elements, and in still other embodiments, separate docking port drives may be used to drive the upper and lower docking ports for a given tubular spray elements. Moreover, as discussed above, other motors and drives may be used as an alternative to stepper motors, and in some embodiments, separate position sensors may be used to sense the position of the tubular spray element.

With particular reference to FIG. 13, housing 328 of docking arrangement 302 may serve as a manifold to convey fluid to all of docking ports 314-324. Given housing 328's placement on the rear wall of the wash tub and at an intermediate elevation suitable for positioning tubular spray elements beneath and/or within an upper rack, housing 328 may include a lower inlet port 350 that receives fluid from a fluid supply (e.g., via a first generally vertical conduit disposed along the rear wall of the wash tub) as well as an upper outlet port 352 that conveys fluid to one or more upper sprayers (e.g., a ceiling-mounted spray arm or one or more tubular spray elements disposed above the upper rack). Furthermore, a pair of lateral channels 354, 356 convey fluid received from lower port 350 to docking ports 314, 318, 320 and 324 for side tubular spray elements 304 and 308. In other embodiments, other arrangements of ports may be used, e.g., no upper port if no sprayers are disposed above rack 310, or no lateral channels such that each docking port or each pair of upper and lower docking ports is supplied with fluid separately.

With particular reference to FIG. 14, each docking port 314-324 also includes a valve 358 that restricts flow from one or more inlets 360 to the outlet port 334 of the respective docking port. Valve 358 may be actuated in different embodiments via axial, rotational or other movement. For example, valve 358 may be implemented using a flap or cup-shaped check valve as described in the second cross-referenced application discussed above, or may be selectively opened or closed based upon rotational movement as also discussed in the aforementioned cross-referenced application. Other manners of regulating and/or inhibiting flow from a docking port may be used in other embodiments, as will be appreciated by those of ordinary skill having the benefit of the instant disclosure.

In this embodiment, coupling plate 330 and gear 344 of each rotatable docking port 314-324 are movable axially along their axes of rotation, and biased via a spring 362 or other biasing member to a forward position (i.e., toward a tubular spray element and away from the rear wall of the wash tub. Idler gear 346 has a sufficient depth such that gear 344 remains engaged with idler gear 346 throughout its linear stroke or range of movement along axis of rotation A.

In other embodiments, however, idler gear 346 may be sized, and coupling plate 330 and gear 344 may have a range of movement, that is sufficient to disengage gear 344 from idler gear 346 when coupling plate 330 and gear 344 are in the forward position. By doing so, when no tubular spray element is coupled to a rotatable docking port 314-324 (e.g., as is the case for tubular spray element 364 shown in FIG. 14 opposite docking port 314), the gear 344 will be disengaged from idler gear 346. Likewise, when a tubular spray element (e.g., as is the case for tubular spray element 304) is inserted into engagement with a rotatable docking port (e.g., rotatable docking port 320), the gear 344 will be pushed rearwardly into engagement with idler gear 346. In addition, in some embodiments, rotation of idler gear 346 may also control actuation of valve 358, although the invention is not so limited. As such, rotation of stepper motor 340 in some embodiments may only cause rotation of the particular rotatable docking port 314-324 within which a tubular spray element has been inserted.

In still other embodiments, a gear 344 may not be axially movable, and thus may always mechanically engage with a docking port drive such as stepper motor 340 such that both upper and lower docking ports rotate together irrespective of whether a tubular spray element is coupled thereto. In such embodiments, however, it may still be desirable to enable coupling plate 330 to move axially in order to facilitate reestablishing a predetermined angular relationship with a tubular spray element, as will be discussed in greater detail below. For example, in such an embodiment a bias member such as a spring may be disposed between coupling plate 330 and gear 344 to bias the coupling plate to the forward position while maintaining gear 344 at a fixed position along the axis.

It will be appreciated by those of ordinary skill having the benefit of the instant disclosure that other valve designs, as well as other valve actuation mechanisms, may be used in connection with tubular spray element docking ports in other embodiments, and therefore, the invention is not limited to the specific implementations discussed herein. Furthermore, it will be appreciated that the various docking ports described herein may be used in groups of three or more to support additional rack elevations, or may be used singularly in connection with a non-adjustable rack.

Furthermore, it will be appreciated that many of the various components discussed herein may be used in connection with rotatable conduits other than the tubular spray elements discussed above. In particular, rotatable docking ports consistent with the invention and/or the various check and/or diverter valves discussed above may be utilized in connection with other types of rack-mounted conduits to support rotation of the conduits along with supplying fluid thereto. A conduit, in this regard, may be considered to include any component including one or more channels for communicating fluid. A conduit may include one or more apertures, nozzles or sprayers in some embodiments, while in other embodiments, a conduit may merely communicate fluid to another component, and itself may have no openings for spraying fluid onto utensils in a wash tub. As one example, a conduit may be mechanically coupled to a separate spray arm or other sprayer mounted in a rack (e.g., via one or more gears) such that rotation of the conduit imparts movement to the attached spray arm or sprayer. In addition, while tubular spray elements are illustrated as being predominantly cylindrical in nature, conduits in other embodiments may have other profiles and shapes, so the invention is not so limited. Moreover, it will be appreciated by those of ordinary skill having the benefit of the instant disclosure that many of the techniques and components discussed herein may be utilized in connection with non-rotatable docking ports and non-rotatable conduits. Additional variations will be appreciated by those of ordinary skill having the benefit of the instant disclosure.

As noted above, a keyed coupling may be used in some embodiments to enable a predetermined angular relationship between a tubular spray element and a rotatable docking port or other component of a docking arrangement. In the embodiment of FIGS. 13-15, the keyed coupling may be implemented in part using coupling plate 332, which faces a rotatable docking port 314-324 and functions as a keyed connector for mating with the rotatable docking port when the rack is in the washing position such that rotation of the rotatable docking port causes rotation of the tubular spray element upon which the coupling plate is disposed. Coupling plate 330, disposed on a rotatable docking port 314-324, likewise functions as a port connector that faces the keyed connector (coupling plate 332) and is configured to mate with the keyed connector when the rotatable docking port and the keyed connector are at the predetermined angular relationship.

With specific reference to FIG. 15, a keyed coupling in some embodiments may be implemented using pairs of keying elements disposed at predetermined angular positions about axis of rotation A on their respective coupling plates and at predetermined radii from the axis of rotation A. One pair of keying elements, for example, includes a projection 364 on coupling plate 332 that is configured to engage a corresponding recess 366 on coupling plate 330.

Another pair of keying elements, for example, includes a projection 368 on coupling plate 332 that is configured to engage a corresponding recess 370 on coupling plate 330. Projection 364 and recess 366 are disposed at a first radius $r_1$ from axis of rotation A, while projection 368 and recess 370 are disposed at a second (and different) radius $r_2$ from axis of rotation A, thus ensuring that there is only a single angular relationship between coupling plates 330, 332 in which both sets of keying elements will be engaged with one another. It should also be noted that each recess 366, 370 is sized and configured to receive its respective projection 364, 368, and it should also be appreciated that the projections 364, 368 may be differently configured from one another in some embodiments, or may be identically configured to one another in other embodiments.

Moreover, each coupling plate 330, 332 defines a respective mating surface 372, 374, with projections 364, 368 extending beyond mating surface 374 and recesses 366, 370 disposed on mating surface 372. Mating surfaces 372, 374 oppose one another and, when projections 364, 368 are received in recesses 366, 370, abut one another to form a seal between outlet port 334 and inlet port 336.

Moreover, it is generally desirable to configure a keyed coupling to permit relative rotation between a rotatable conduit or tubular spray element and a rotatable docking port when the rack is in the washing position and the predetermined angular relationship has not been established. By doing so, the rotatable docking port can be rotated without also causing concurrent rotation of the rotatable conduit or tubular spray element until the rotatable docking port rotates to the predetermined angular relationship, whereby the keyed coupling will engage such that further rotation of the rotatable docking port will cause concurrent rotation of the rotatable conduit or tubular spray element and maintenance of the predetermined angular relationship. Thus, after a rack has been moved from the washing position to the loading position and the rotatable conduit or tubular spray element has disengaged from the rotatable docking port the predetermined angular relationship can be reestablished regardless of whether the rotatable conduit or tubular spray element has been moved while the two components are disengaged from one another. It will be appreciated that, for example, movement of the rack or loading/unloading dishes may cause inadvertent movement of a rotatable conduit while disengaged, so the keyed coupling described herein may enable the predetermined angular relationship to be reestablished without concern for whether or not any such movement has occurred.

In the illustrated embodiment of FIGS. 13-15, the relative rotation between a rotatable conduit and a rotatable docking port may be supported in part by the axial movement of rotatable docking port 320 along axis A. In particular, with reference to FIG. 15, when a rack is moved from a loading position to a washing position and the rotatable docking port 320 is not at the predetermined angular relationship relative to tubular spray element 304, projections 364, 368 will not be aligned with recesses 366, 370, and will instead abut mating surface 372, with the bias of spring 362 overcome to displace mating surface 372 rearwardly by a distance similar to the height of the projections extending from mating surface 374. In this configuration, rotation of rotatable docking port 320 will not cause concurrent rotation of tubular spray element 304, and projections 364, 368 will follow an annular path about axis of rotation A until the predetermined angular relationship is reestablished, whereby the projections 364, 368 will be received into recesses 366, 370, spring 362 will displace mating surface 372 in a forward direction to abut mating surface 374. Further rotation of rotatable docking port 320 will then cause concurrent rotation of tubular spray element 304 until such time as the rack is moved to the loading position and the tubular spray element disengages from the rotatable docking port.

It will also be appreciated that axial movement of rotatable docking port 320 may necessitate the use of a seal 376 (e.g., a radial seal, a face seal, an axial seal, etc.) to facilitate fluid communication from a rotatable docking port to a tubular spray element with what is effectively a variable length rotational shaft for the docking port. Seal 376, in this embodiment, forms an external seal between a shaft 378 and valve 358 such that fluid entering an inlet 360 is conveyed through valve 358, shaft 378 and outlet port 334 to inlet port 336 of tubular spray element 304 when the predetermined angular relationship has been established.

Various alternate keyed couplings may be used in other embodiments. For example, rather than being generally transverse to the axis of rotation as is illustrated in FIGS. 13-15, mating surfaces in other embodiments may be oriented in different directions (e.g., having conical profiles in some embodiments), and in some embodiments contiguous mating surfaces may be omitted. In addition, keyed elements may vary in other embodiments, e.g., through the use of projections on a docking port and recesses on a rotatable conduit, or through the use of both projections and recesses on each of a docking port and a rotatable conduit. Furthermore, as illustrated by keyed connector 400 of FIG. 16, which is shown disposed on the end of a rotatable conduit 402 having two projections 404 disposed on a mating surface 406, projections in some embodiments may include angled or ramped surfaces 408 to facilitate relative rotation between a rotatable docking port and a rotatable conduit when not at a predetermined angular relationship as well as engagement between a projection and a recess when the predetermined angular relationship is reached. Recesses in some embodiments may also include ramped surfaces.

In addition, as illustrated by keyed connector 420 of FIG. 17, which is shown disposed on the end of a rotatable conduit 422, different numbers of paired keying elements may be utilized in some embodiments. For keyed connector 420, a single projection 424 is disposed on a mating surface 426, with a single recess (not shown in FIG. 17) provided on the port connector on the rotatable docking port with which the keyed connector mates. It will also be appreciated that three or more pairs of keying elements may be used in other embodiments.

As also illustrated in this figure, different projection profiles may be used as an alternative to the rectangular shapes illustrated in FIGS. 13-15, whereby projection 424 is cylindrical and has a circular cross-sectional profile. FIG. 17 also illustrates how alternate fluid couplings may be used between a rotatable conduit and a rotatable docking port. In particular, rotatable conduit 422 includes an inlet port 428 that is configured to be inserted into a rotatable docking port.

In addition, rather than utilizing an axially-movable docking port, in some embodiments a keying element may be axially-movable, as may a mating portion of a rotatable conduit. For example, in some embodiments, projection 424 may be axially-movable and may be biased to an extended position as illustrated in FIG. 17. When mating surface 426 is brought into contact with an opposing mating surface on a rotatable docking port when the rotatable docking port and rotatable conduit 422 are not in a predetermined angular relationship, projection 424 may be retracted at least partially into mating surface 426 as its spring bias is overcome by the contact with the opposing mating surface. Then, when the predetermined angular relationship is reached at projection 424 is aligned with a corresponding recess in the opposing mating surface, the projection may extend and engage the recess. In still other embodiments, a spring-biased projection may also be used on a rotatable docking port, with a cooperative recess disposed on the mating surface of a rotatable conduit. Other variations will be appreciated by those of ordinary skill having the benefit of the instant disclosure.

Figure 18:
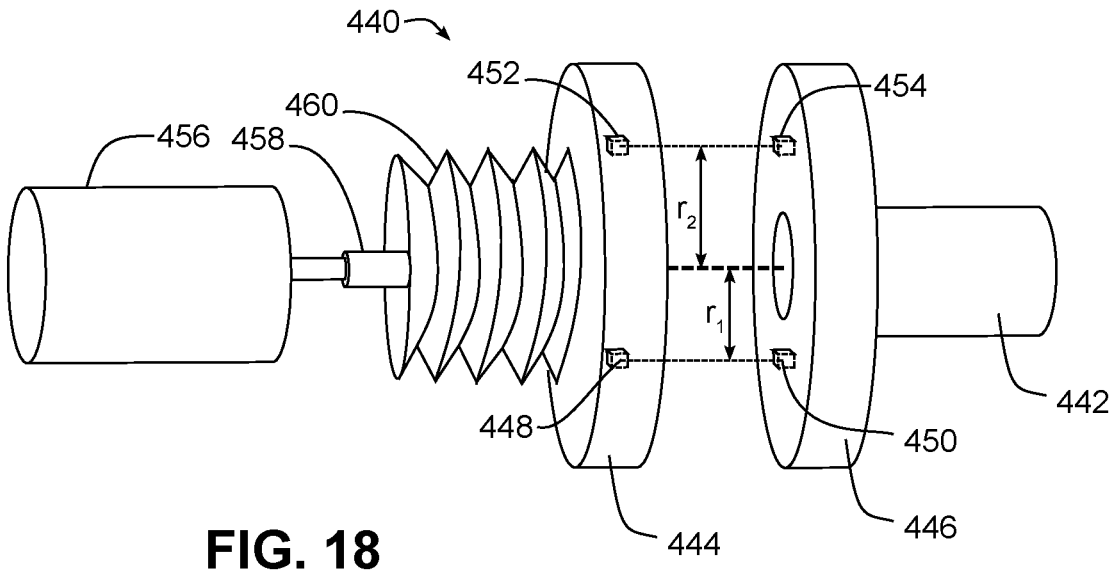
FIG. 18 illustrates another example rotatable dock and coupling plate implementation suitable for use in some embodiments consistent with the invention.

FIG. 18 illustrates another implementation of a keyed coupling featuring a number of other variations to the other implementations discussed above. In this embodiment, a rotatable docking port 440 opposes a tubular spray element 442, with respective coupling plates 444, 446 disposed thereon. Rather than using mechanically-based keying elements such as projections and/or recesses, magnetic keying is used, whereby a first pair of magnetic keying elements 448, 450 are respectively disposed at predetermined angular positions about the axis of rotation of coupling plates 444, 446 and at a first radius $r_1$ from the axis of rotation and a second pair of magnetic keying elements 452, 454 are respectively disposed at different predetermined angular positions about the axis of rotation of coupling plates 444, 446 and at a second and different radius $r_2$ from the axis of rotation, thus ensuring that there is only a single angular relationship between coupling plates 444, 446 in which both sets of keying elements will be engaged with one another. In this embodiment, all of magnetic keying elements 448-454 may be magnets (e.g., rare earth magnets, permanent magnets, electromagnets, etc.), while in other embodiments only one of each pair of keying elements may be a magnet, with the other keying element being a ferromagnetic material that will be attracted to the magnet used in the other keying element of the pair.

FIG. 18 also illustrates another variation, whereby rather than being driven by an offset drive through a series of gears, a rotatable docking port in some embodiments may be driven directly by a stepper motor 456 having a shaft 458 that is coaxial with the axis of rotation of the rotatable docking port. Further, it may be desirable in some embodiments for shaft 458 to be variable in length (e.g., with an internal spring) and to use a bellows seal 460 to provide sealing around the shaft. Alternatively, a spring or other bias member may be disposed within bellows seal 460 to bias the coupling plate to a forward position.

Figure 19:
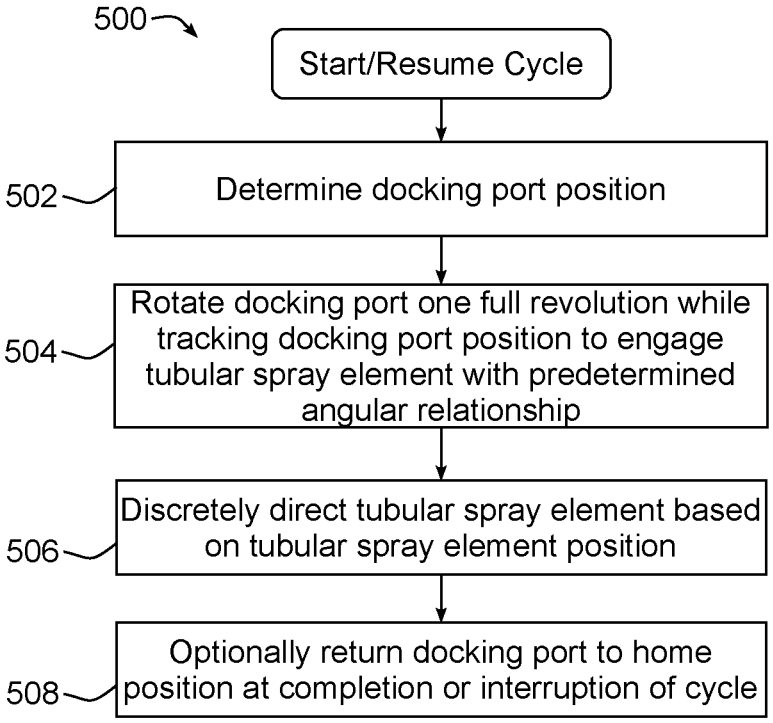
FIG. 19 is a flowchart illustrating an example sequence of operations for discretely directing a tubular spray element during a wash cycle using the dishwasher of FIG. 1.

FIG. 19 next illustrates an example sequence of operations 500, e.g., as may be performed by controller 30 of dishwasher 10, to control a tubular spray element configured with a keyed coupling and otherwise as described herein. The sequence may be initiated, for example, at the start of a wash cycle or after a wash cycle is resumed (e.g., after the dishwasher door has been opened or the cycle has been interrupted). In block 502, the position of the rotatable docking port is determined, e.g., using a position sensor or based upon the rotatable docking port having previously been returned to a known "home" position.

Next, in block 504, the docking port may be rotated a predetermined amount of rotation (e.g., a full revolution, although multiple revolutions, a portion of a revolution, etc. may also be used in other embodiments) while tracking the position of the docking port to engage the tubular spray element with the rotatable docking port and with the predetermined angular relationship. It will be appreciated that during this operation, the predetermined angular relationship may potentially be reached at any point during the rotation of the docking port depending upon how close the docking port and the tubular spray element were to the predetermined angular relationship at the beginning of the operation. Nonetheless, at the completion of the revolution, it will generally be assured that the keyed coupling has been engaged and the predetermined angular relationship has been established or reestablished between the rotatable docking port and the tubular spray element. Moreover, based upon the known docking port rotational position that is tracked during the rotation, the tubular spray element will also be known based upon the fixed offset of the tubular spray element from the rotatable docking port when at the predetermined angular relationship.

Thereafter, in block 506, the wash cycle proceeds, and the tubular spray element is discretely directed to various rotational positions to wash utensils in the dishwasher. Then, in block 508, at the conclusion of the wash cycle, or when the cycle is interrupted, the rotatable docking port may optionally be returned to a home position.

Therefore, in some embodiments of the invention, one or more rotatable conduits such as tubular spray elements are supported in a movable dishwasher rack, and a docking arrangement incorporating one or more rotatable docking ports is utilized to mechanically and fluidly couple with the conduits to both rotate and supply pressurized air and/or liquid to the conduits. A keyed coupling is utilized between each rotatable docking port and rotatable conduit to establish or reestablish a predetermined angular relationship therebetween, even after a rotatable conduit is disengaged from a rotatable docking port due to movement of the rack.

Various additional modifications may be made to the illustrated embodiments consistent with the invention. Therefore, the invention lies in the claims hereinafter appended.

What is claimed is:

1. A dishwasher, comprising:

a wash tub;

a rotatable docking port coupled to a wall of the wash tub and in fluid communication with a fluid supply;

a rack supported in the wash tub and movable between loading and washing positions;

a rotatable conduit supported by the rack for movement with the rack and configured to receive fluid from the rotatable docking port when the rack is in the washing position; and a keyed connector disposed at an end of the rotatable conduit facing the rotatable docking port, the keyed connector configured to mate with the rotatable docking port at a predetermined angular relationship to the rotatable docking port when the rack is in the washing position such that rotation of the rotatable docking port causes rotation of the rotatable conduit, the keyed connector configured to disengage from the rotatable docking port when the rack is moved to the loading position;

wherein the keyed connector is configured to permit relative rotation between the rotatable conduit and the rotatable docking port when the rack is in the washing position and the keyed connector and the rotatable docking port are not at the predetermined angular relationship, and wherein rotation of the rotatable docking port to the predetermined angular relationship causes the keyed connector to mate with the rotatable docking port such that further rotation of the rotatable docking port causes rotation of the rotatable conduit.

2. The dishwasher of claim 1, wherein the rack is adjustable between first and second elevations within the wash tub, wherein the rotatable docking port is a first rotatable docking port positioned to receive the connector of the rotatable conduit when the rack is adjusted to the first elevation and disposed in the washing position, and wherein the docking arrangement includes a second rotatable docking port positioned to receive the connector of the rotatable conduit when the rack is adjusted to the second elevation and disposed in the washing position.

3. The dishwasher of claim 1, wherein the conduit comprises a tubular spray element being rotatable about a longitudinal axis thereof, wherein the tubular spray element includes one or more apertures extending through an exterior surface thereof to spray fluid received from the rotatable docking port, and wherein the dishwasher further comprises a tubular spray element drive coupled to the rotatable docking port to rotate the rotatable docking port to discretely direct the tubular spray element to each of a plurality of rotational positions about the longitudinal axis thereof.

4. The dishwasher of claim 3, further comprising a controller coupled to the tubular spray element drive, wherein the controller is configured to, prior to discretely directing the tubular spray element to a predetermined rotational position, rotate the rotatable docking port a predetermined amount of rotation to ensure that the rotatable docking port rotates to the predetermined angular relationship to cause the keyed connector to mate with the rotatable docking port.

5. The dishwasher of claim 4, wherein the tubular spray element drive comprises a stepper motor including a position sensor, wherein the stepper motor includes a first gear coupled to a drive shaft thereof, wherein the rotatable docking port includes a second gear that is mechanically coupled to the first gear such that rotation of the first gear by the stepper motor rotates the rotatable docking port, and wherein the controller is configured to track the rotational position of the rotatable docking port using the position sensor.

6. The dishwasher of claim 5, wherein the controller is configured to return the rotatable docking port to a predetermined rotational position when the keyed connector is disconnected from the rotatable docking port.

7. The dishwasher of claim 1, wherein the rotatable docking port includes a port connector configured to mate with the keyed connector when the rotatable docking port and the keyed connector are at the predetermined angular relationship, wherein the keyed connector includes a first keying element disposed at a first angular position on the keyed connector and the port connector includes a second keying element disposed at a second angular position on the port connector, and wherein the first and second keying elements are configured to engage one another to resist relative rotation between the keyed connector and the port connector when the rotatable docking port and the keyed connector are at the predetermined angular relationship and to permit relative rotation between the keyed connector and the port connector when the rotatable docking port and the keyed connector are not at the predetermined angular relationship.

8. The dishwasher of claim 7, wherein the keyed connector includes a first mating surface, wherein the port connector includes a second mating surface configured to oppose with the first mating surface when the rack is in the washing position, and wherein the first and second keying elements are respectively disposed on the first and second mating surfaces proximate a first radius from an axis of rotation of the rotatable docking port and the rotatable conduit.

9. The dishwasher of claim 8, wherein one of the first and second keying elements includes a projection that extends beyond the respective first or second mating surface, and wherein the other of the first and second keying elements includes a recess disposed on the respective first or second mating surface, the recess sized and configured to receive the projection when the keyed connector and the rotatable docking port are at the predetermined angular relationship.

10. The dishwasher of claim 9, wherein the second mating surface is further movable along the axis of rotation and biased towards the keyed connector such that when the keyed connector and the rotatable docking port are not at the predetermined angular relationship the projection abuts the first or second mating surface upon which the recess is disposed.

11. The dishwasher of claim 10, wherein the first mating surface includes an inlet port and the second mating surface includes an outlet port positioned opposite the inlet port when the keyed connector and the rotatable docking port are at the predetermined angular relationship to communicate fluid from the rotatable docking port to the rotatable conduit, and wherein the rotatable docking port includes a seal configured to maintain a seal as the second mating surface moves along the axis of rotation.

12. The dishwasher of claim 11, wherein the seal comprises a bellows seal, a radial seal, face seal or an axial seal.

13. The dishwasher of claim 9, wherein the projection includes a ramped surface.

14. The dishwasher of claim 9, wherein the first and second mating surfaces are substantially transverse to the axis of rotation.

15. The dishwasher of claim 9, wherein the keyed connector includes a third keying element disposed at a third angular position on the keyed connector and the port connector includes a fourth keying element disposed at a fourth angular position on the port connector, wherein the third and fourth keying elements are configured to engage one another to resist relative rotation between the keyed connector and the port connector when the rotatable docking port and the keyed connector are at the predetermined angular relationship and to permit relative rotation between the keyed connector and the port connector when the rotatable docking port and the keyed connector are not at the predetermined angular relationship, wherein the third and fourth keying elements are respectively disposed on the first and second mating surfaces proximate a second radius from an axis of rotation of the rotatable docking port and the rotatable conduit, and wherein the first radius is different than the second radius.

16. The dishwasher of claim 9, wherein the projection is at least partially retractable into the respective first or second mating surface and is biased to an extended position that extends beyond the respective first or second mating surface.

17. The dishwasher of claim 1, wherein the keyed connector includes a first keying element disposed at a first angular position on the keyed connector and the rotatable docking port includes a second keying element disposed at a second angular position on the rotatable docking port, wherein at least one of the first and second keying elements includes a magnet, and wherein the first and second keying elements are configured to magnetically engage one another to resist relative rotation between the keyed connector and the rotatable docking port when the rotatable docking port and the keyed connector are at the predetermined angular relationship.

18. A dishwasher, comprising:

a wash tub;

a rack supported in the wash tub and movable between loading and washing positions;

a rotatable connector rotatably coupled to a wall of the wash tub to rotate about an axis of rotation and including a first keying element disposed at a predetermined angular position on the rotatable connector and separated from the axis of rotation by a predetermined radius;

a rotatable conduit supported by the rack for movement with the rack and configured to rotate about the axis of rotation; and a keyed connector disposed at an end of the rotatable conduit facing the rotatable connector and including a second keying element disposed at a predetermined angular position on the keyed connector separated from the axis of rotation by the predetermined radius, the keyed connector configured to disengage from the rotatable connector when the rack is moved to the loading position;

wherein the first and second keying elements are respectively positioned to mate with one another when the keyed connector is at a predetermined angular relationship to the rotatable connector when the rack is in the washing position;

wherein the keyed connector is configured to permit relative rotation between the rotatable conduit and the rotatable connector when the rack is in the washing position and the keyed connector and the rotatable connector are not at the predetermined angular relationship, and wherein rotation of the rotatable connector to the predetermined angular relationship causes the keyed connector to mate with the rotatable connector such that further rotation of the rotatable connector causes rotation of the rotatable conduit.

19. A dishwasher, comprising:

a wash tub;

a rotatable docking port coupled to a wall of the wash tub and in fluid communication with a fluid supply, the rotatable docking port being rotatable about an axis of rotation;

a tubular spray element drive coupled to the rotatable docking port to rotate the rotatable docking port;

a rack supported in the wash tub and movable between loading and washing positions;

a tubular spray element supported by the rack for movement with the rack and rotatable about a longitudinal axis thereof, the tubular spray element including an inlet port configured to receive fluid from the rotatable docking port when the rack is in the washing position and one or more apertures extending through an exterior surface thereof to spray fluid received at the inlet port;

a first coupling plate disposed on an end of the tubular spray element and having a first mating surface extending substantially transverse to the axis of rotation and facing the rotatable docking port;

a second coupling plate disposed on an end of the rotatable docking port and having a second mating surface extending substantially transverse to the axis of rotation and facing the tubular spray element, wherein the second coupling plate is further movable along the axis of rotation and is biased toward the tubular spray element;

a first projection disposed on the first coupling plate at a first angular position on the first coupling plate and at a first radius from the axis of rotation, the first projection extending from the first mating surface;

a second projection disposed on the first coupling plate at a second angular position on the first coupling plate and at a second radius from the axis of rotation, the second projection extending from the first mating surface, and the second radius different from the first radius;

a first recess disposed on the second coupling plate at a first angular position on the second coupling plate and at the first radius from the axis of rotation, the first recess extending into the second mating surface and sized and configured to receive the first projection when the first and second coupling plates are at a predetermined angular relationship to one another;

a second recess disposed on the second coupling plate at a second angular position on the second coupling plate and at the second radius from the axis of rotation, the second recess extending into the second mating surface and sized and configured to receive the second projection when the first and second coupling plates are at the predetermined angular relationship to one another; and a controller coupled to the tubular spray element drive, wherein the controller is configured to rotate the rotatable docking port a predetermined amount of rotation to ensure that the rotatable docking port rotates relative to the tubular spray element to establish the predetermined angular relationship between the first and second coupling plates and thereby cause the first and second projections to respectively engage with the first and second recesses, and wherein the controller is further configured to thereafter rotate the rotatable docking port to discretely direct the tubular spray element to a predetermined rotational position.

* * * * *